US011789479B2

(12) United States Patent
Kim

(10) Patent No.: US 11,789,479 B2
(45) Date of Patent: Oct. 17, 2023

(54) LOW DROP-OUT REGULATOR AND MOBILE DEVICE

(71) Applicant: SAMSUNG ELECTRONICS CO., LTD., Suwon-si (KR)

(72) Inventor: Jungmoon Kim, Namyangju-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/684,600

(22) Filed: Mar. 2, 2022

(65) Prior Publication Data

US 2023/0025117 A1 Jan. 26, 2023

(30) Foreign Application Priority Data

Jul. 21, 2021 (KR) ..... 10-2021-0095508

(51) Int. Cl.
*G05F 1/575* (2006.01)
*G05F 1/565* (2006.01)
*G09G 3/3208* (2016.01)

(52) U.S. Cl.
CPC ..... *G05F 1/575* (2013.01); *G05F 1/565* (2013.01); *G09G 3/3208* (2013.01); *G09G 2310/0243* (2013.01); *G09G 2320/0626* (2013.01); *G09G 2330/021* (2013.01)

(58) Field of Classification Search
None
See application file for complete search history.

(56) References Cited

U.S. PATENT DOCUMENTS

| | | | | |
|---|---|---|---|---|
| 6,046,577 | A | 4/2000 | Rincon-Mora et al. | |
| 7,323,853 | B2 | 1/2008 | Tang et al. | |
| 8,922,179 | B2 | 12/2014 | Kadanka | |
| 9,104,221 | B2 | 8/2015 | Kim | |
| 10,013,010 | B1 | 7/2018 | Ock et al. | |
| 10,146,240 | B1 * | 12/2018 | Wang | G05F 3/242 |
| 2005/0017767 | A1 * | 1/2005 | Huang | H03F 3/217 327/110 |
| 2009/0224737 | A1 | 9/2009 | Lou | |
| 2013/0235620 | A1 * | 9/2013 | Morris | H02M 3/335 363/21.12 |
| 2015/0061623 | A1 | 3/2015 | Lee | |
| 2017/0097649 | A1 * | 4/2017 | Lee | G09G 3/3696 |
| 2018/0090984 | A1 * | 3/2018 | Ku | H02M 3/04 |
| 2018/0120876 | A1 * | 5/2018 | Petenyi | G05F 1/575 |
| 2019/0190507 | A1 * | 6/2019 | Remple | G05F 1/575 |
| 2020/0304112 | A1 * | 9/2020 | Zhang | H02H 1/0007 |
| 2021/0011505 | A1 * | 1/2021 | Chien | G05F 1/575 |

(Continued)

*Primary Examiner* — Benjamin C Lee
*Assistant Examiner* — Emily J Frank
(74) *Attorney, Agent, or Firm* — Sughrue Mion, PLLC

(57) ABSTRACT

A low drop-out (LDO) regulator includes a power transistor, an error amplifier and a droop adjusting circuit. The power transistor regulates a driving voltage based on a gate voltage of a gate node to provide an output voltage at an output node. The error amplifier outputs the gate voltage by amplifying a voltage difference between a reference voltage and a feedback voltage proportional to the output voltage. The droop adjusting circuit is connected between the gate node and the output node, is coupled to the output voltage, and adjusts the gate voltage to compensate for a change of the output voltage based on a change of a load current which is provided to a load from the output node.

22 Claims, 24 Drawing Sheets

(56) References Cited

U.S. PATENT DOCUMENTS

| | | | | |
|---|---|---|---|---|
| 2021/0089068 | A1* | 3/2021 | Manohar | G05F 1/59 |
| 2021/0333812 | A1* | 10/2021 | Liu | G05F 1/563 |
| 2021/0356979 | A1* | 11/2021 | Liu | G09G 3/20 |

* cited by examiner

LOW DROP-OUT REGULATOR AND MOBILE DEVICE

CROSS-REFERENCE TO RELATED APPLICATION(S)

This application is based on and claims priority under 35 USC § 119 to Korean Patent Applications No. 10-2021-0095508, filed on Jul. 21, 2021 in the Korean Intellectual Property Office (KIPO), the contents of which are incorporated herein in its entirety by reference.

BACKGROUND

1. Field

Example embodiments generally relate to electronic devices. More particularly, example embodiments relate to low drop-out regulators and mobile devices including the same.

2. Description of the Related Art

Various flat panel display devices that reduce weight and volume have been developed. An organic light emitting diode (OLED) display device has advantages such as rapid response speed and low power consumption among the flat panel display devices because the OLED device displays an image using an organic light emitting diode that emits light based on recombination of electrons and holes.

The OLED display device may include a display panel including a plurality of pixels arranged in a matrix format and each of the pixels includes transistors and an OLED element that emits light corresponding to a voltage applied to the OLED element.

Various mobile devices may include a low drop out (LDO) regulator, which generates an operating voltage based on a driving voltage, and in various situations, the LDO regulator needs to generate a stable operating voltage.

SUMMARY

According to an aspect of the disclosure, there is provided an LDO regulator capable of generating a stable operating voltage when a load current increases.

According to another aspect of the disclosure, there is provided a mobile device including an LDO regulator capable of generating a stable operating voltage when a load current increases.

According to an aspect of the disclosure, there is provided a low drop-out (LDO) regulator including: a power transistor configured to regulate a driving voltage based on a gate voltage of a gate node of the power transistor to provide an output voltage at an output node; an error amplifier configured to output the gate voltage by amplifying a voltage difference between a reference voltage and a feedback voltage based on the output voltage; and a droop adjusting circuit configured to receive the output voltage and adjust the gate voltage to compensate for a change of the output voltage based on a change of a load current provided to a load at the output node.

According to another aspect of the disclosure, there is provided a mobile device including: a display panel including a plurality of pixels; a driving circuit configured to provide a plurality of scan signals to the display panel through a plurality of scan lines and provide data voltages to the data lines through a plurality of data lines; a voltage generator including at least one low drop-out (LDO) regulator configured to generate an operating voltage based on a first driving voltage, the voltage generator configured to provide the operating voltage to the driving circuit; and a power management application circuit (PMIC) configured to apply a high power supply voltage and a low power supply voltage to the display panel and configured to generate the first driving voltage and a second driving voltage based on a battery voltage, wherein the driving circuit is configured to generate at least one of the plurality of scan signals based on the operating voltage, and wherein the at least one LDO regulator includes: a power transistor configured to regulate the first driving voltage based on a gate voltage of a gate node of the power transistor to provide an output voltage at an output node; an error amplifier configured to output the gate voltage by amplifying a voltage difference between a reference voltage and a feedback voltage based on the output voltage; and a droop adjusting circuit configured to receive the output voltage and adjust the gate voltage to compensate for a change of the output voltage based on a change of a load current provided to a load at the output node.

According to another aspect of the disclosure, there is provided a low drop-out (LDO) regulator including: a power transistor configured to regulate a driving voltage based on a gate voltage of a gate node of the power transistor to provide an output voltage at an output node; an error amplifier configured to output the gate voltage by amplifying a voltage difference between a reference voltage and a feedback voltage based on the output voltage; and a droop adjusting circuit configured to receive the output voltage and adjust the gate voltage to compensate for a change of the output voltage based on a change of a load current provided to a load at the output node; and an adaptive bias circuit configured to copy a supply current provided to the output node through the power transistor based on the gate voltage to generate a first current proportional to the supply current, and configured to adjust a bias current provided to the error amplifier based on the first current, wherein the error amplifier includes a resistive common mode feedback circuit configured to increase an impedance of the error amplifier, and wherein each of the droop adjusting circuit, the adaptive bias circuit and the resistive common mode feedback circuit is selectively activated.

According to another aspect of the disclosure, there is provided an electronic circuit including: a power transistor configured to output an output voltage at an output node based on a driving voltage; and a regulator circuit configured to regulate the driving voltage by selectively activating at least one of: an error amplifier configured to output the gate voltage by amplifying a voltage difference between a reference voltage and a feedback voltage based on the output voltage; a droop adjusting circuit configured to receive the output voltage and adjust the gate voltage to compensate for a change of the output voltage based on a change of a load current provided to a load at the output node; and an adaptive bias circuit configured to copy a supply current provided to the output node through the power transistor based on the gate voltage to generate a first current proportional to the supply current, and configured to adjust a bias current provided to the error amplifier based on the first current.

BRIEF DESCRIPTION OF THE DRAWINGS

Illustrative, non-limiting example embodiments will be more clearly understood from the following detailed description taken in conjunction with the accompanying drawings.

DESCRIPTION OF EMBODIMENTS

Figure 1:
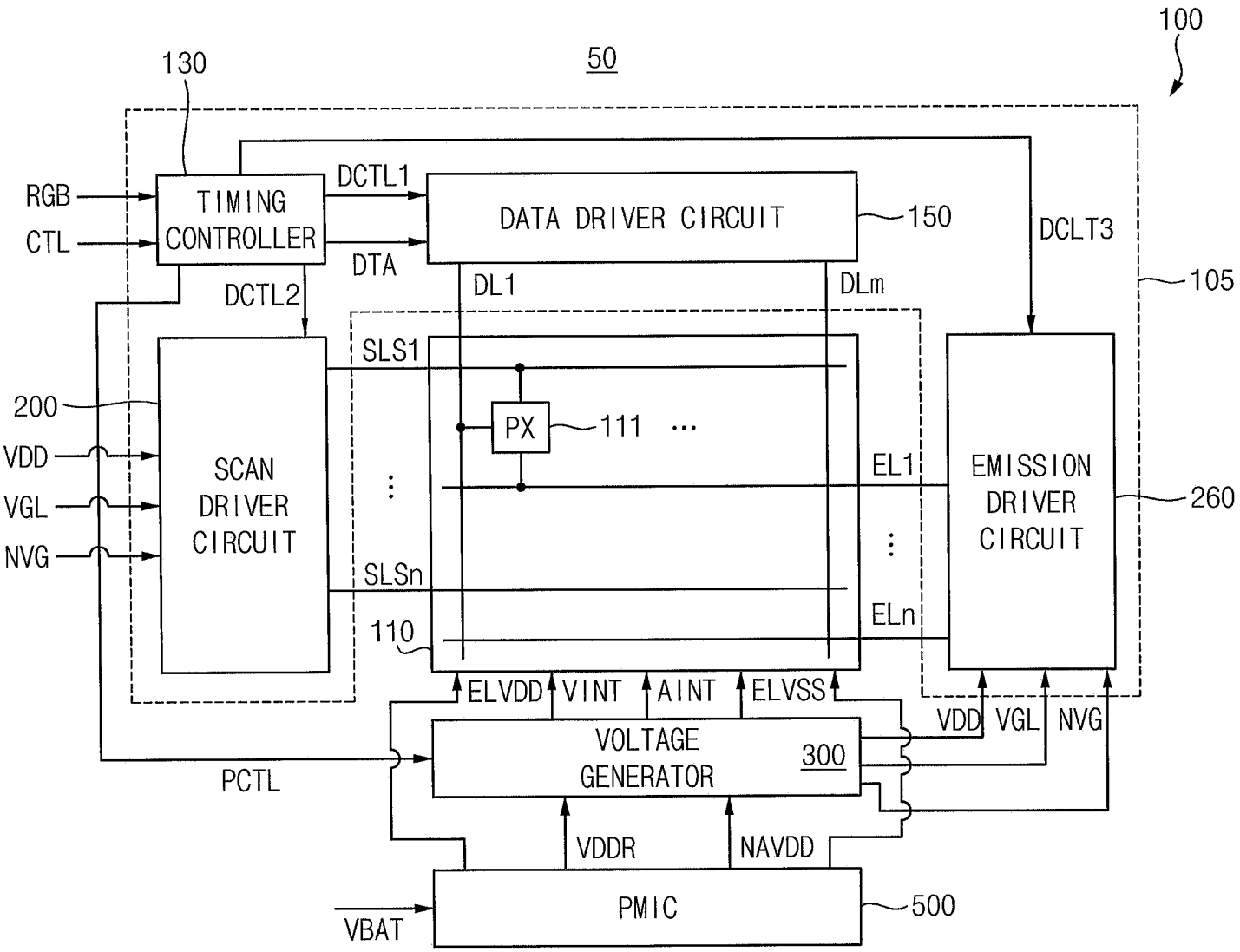
FIG. 1 is a block diagram illustrating a mobile device according to example embodiments.

The example embodiments are described more fully hereinafter with reference to the accompanying drawings. Like or similar reference numerals refer to like or similar elements throughout.

FIG. 1 is a block diagram illustrating a mobile device according to example embodiments.

Referring to FIG. 1, a mobile device 50 may include an organic light emitting diode (OLED) display device 100 and a power management integrated circuit (PMIC) 500.

The OLED display device 100 may include a driving circuit 105, a display panel 110 and a voltage generator 300.

The driving circuit 105 and the voltage generator 300 may constitute a display driving integrated circuit.

The driving circuit 105 may include a timing controller 130, a data driver circuit 150, a scan driver circuit 200, and an emission driver circuit 260.

The timing controller 130, the data driver circuit 150, the scan driver unit circuit 200, and the emission driver circuit 260 may be coupled to the display panel 110 by a chip-on flexible printed circuit (COF), a chip-on glass (COG), a flexible printed circuit (FPC), etc. However, the disclosure is not limited thereto, and as such, according to another example embodiment, the timing controller 130, the data driver circuit 150, the scan driver unit circuit 200, and the emission driver circuit 260 may be coupled to the display panel 110 in a different manner.

The display panel 110 may be coupled to the scan driver circuit 200 of the driving circuit 105 through a plurality of scan line sets SLS1~may be coupled to the data driver circuit 150 through a plurality of data lines DLP~DLm), and may be coupled to the emission driver circuit 260 of the driving circuit 105 through a plurality of emission control lines EL1~ELn. According to an example embodiment, "n" in SLSn may be an integer greater than three and "m" in DLm may be an integer greater than three. The display panel 110 may include a plurality of pixels 111, and each pixel 111 may be provided at an intersection of each of the scan line sets SLS1~SLSn, each of the data lines DL1~DLm and each of the emission control lines EL1~ELn.

The display panel 110 may receive a first power supply voltage and a second power supply voltage from the PMIC 500. According to an example embodiment, the first power supply voltage may be a high voltage ELVDD and the second power supply voltage may be a low voltage ELVSS.

The display panel 110 may receive a first initialization voltage VINT and a second initialization voltage AINT. According to an example embodiment, the display panel 110 may receive a first initialization voltage VINT and a second initialization voltage AINT from the voltage generator 300. The emission driver circuit 260 may receive a first operating voltage VDD, a second operating voltage VGL and a negative voltage NVG from the voltage generator 300. In addition, the scan driver circuit 300 may receive the first operating voltage VDD, the second operating voltage VGL and the negative voltage NVG from the voltage generator 300.

The scan driver circuit 200 may apply a plurality of scan signals to each of the sub pixels 111 through the first group of scan lines SL11~SL1*n* and the second group of scan lines SL21~SL2*n* based on a second driving control signal DCTL2.

The scan driver circuit 200 may enable at least two scan signals of the plurality of scan signals during non-emission interval in which the pixels do not emit light such that the scan signals are partially overlapped during two consecutive horizontal periods. The horizontal period corresponds to a period of a horizontal synchronization signal which the timing controller 130 uses.

The data driver circuit 150 may apply a data voltage to each of the pixels 111 through the plurality of data lines DL1~DLm based on a first driving control signal DCTL1.

The emission driver circuit 260 may apply an emission control signal to each of the pixels 111 through the plurality of emission control lines EL1~ELn based on a third driving control signal DCTL3. Luminance of the display panel 110 may be adjusted based on the emission control signal.

The voltage generator 300 may provide the first initialization voltage VINT and the second initialization voltage AVINT to the display panel 110, and may provide the first operating voltage VDD, the second operating voltage VGL and the negative voltage NVG to the emission driver circuit 260 and the scan driver circuit 200, in response to a power control signal PCTL.

The voltage generator 180 may vary a level of the second initialization voltage AINT based on the power control signal PCTL indicating a frame rate of an image displayed in the display panel 110.

The timing controller 130 may receive input image data RGB and a control signal CTL, and may generate the first through third driving control signals DCTL1~DCTL3 and the power control signal PCTL based on the control signal CTL. The timing controller 130 may provide the first driving control signal DCTL1 to the data driver circuit 150, the second driving control signal DCTL2 to the scan driver circuit 200, the third driving control signal DCTL3 to the emission driver circuit 260 and the power control signal PCTL to the voltage generator 180. The timing controller 130 may receive the input image data RGB and arrange the input image data RGB to provide a data signal DTA to the data driver circuit 150.

The PMIC 500 may generate a first driving voltage VDDR having a positive level and a second driving voltage NAVDD having a negative level based on a battery voltage VBAT received from a battery and may provide the first driving voltage VDDR and the second driving voltage NAVDD to the voltage generator 300. In addition, the PMIC 500 may generate the high power supply voltage ELVDD and the low power supply voltage ELVSS based on the battery voltage VBAT and may provide the high power supply voltage ELVDD and the low power supply voltage ELVSS to the display panel 110.

Figure 2:
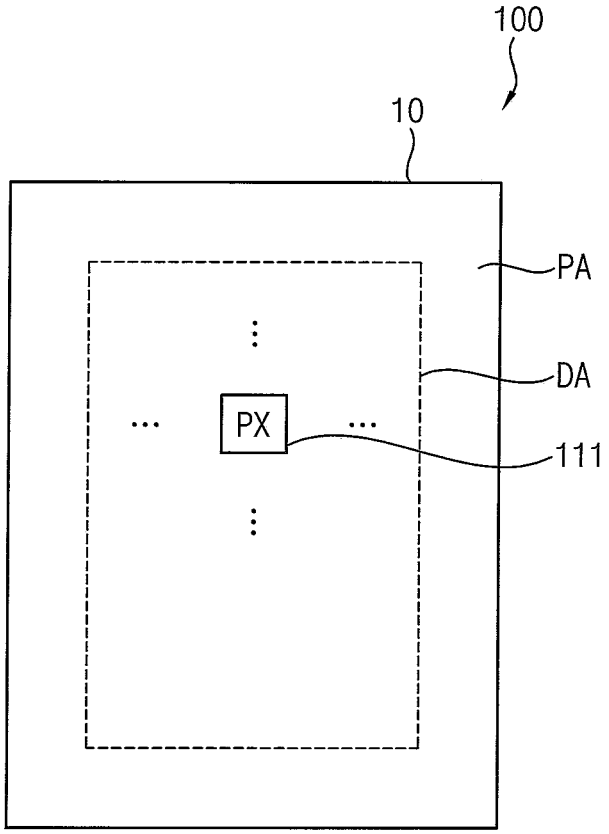
FIG. 2 is a plan view of the OLED display device in the mobile device of FIG. 1 according to example embodiments.

FIG. 2 is a plan view of the OLED display device in the mobile device of FIG. 1 according to example embodiments.

Referring to FIG. 2, the OLED display device 100 includes a substrate 10. The substrate 10 may include a display region DA and a peripheral region PA outside the display region DA.

A plurality of pixels 111 may be arranged in the display region DA of the substrate 10. Various wirings for transmitting an electrical signal to be applied to the driving circuit 105 and the display region DA may be in the peripheral region PA of the substrate 10.

The PMIC 500 may be provided in the peripheral region PA.

Figure 3:
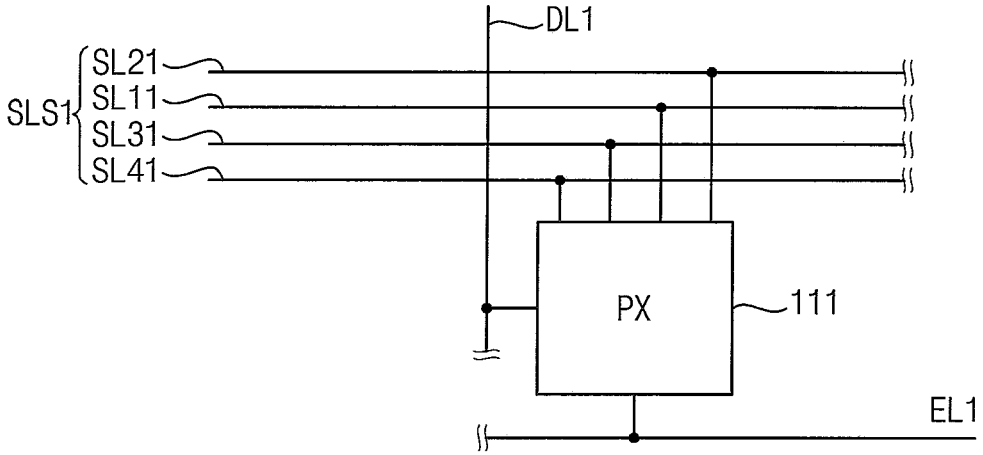
FIG. 3 illustrates connection of a pixel in the OLED display device in FIG. 1.

FIG. 3 illustrates connection of a pixel in the OLED display device in FIG. 1.

Figure 4:
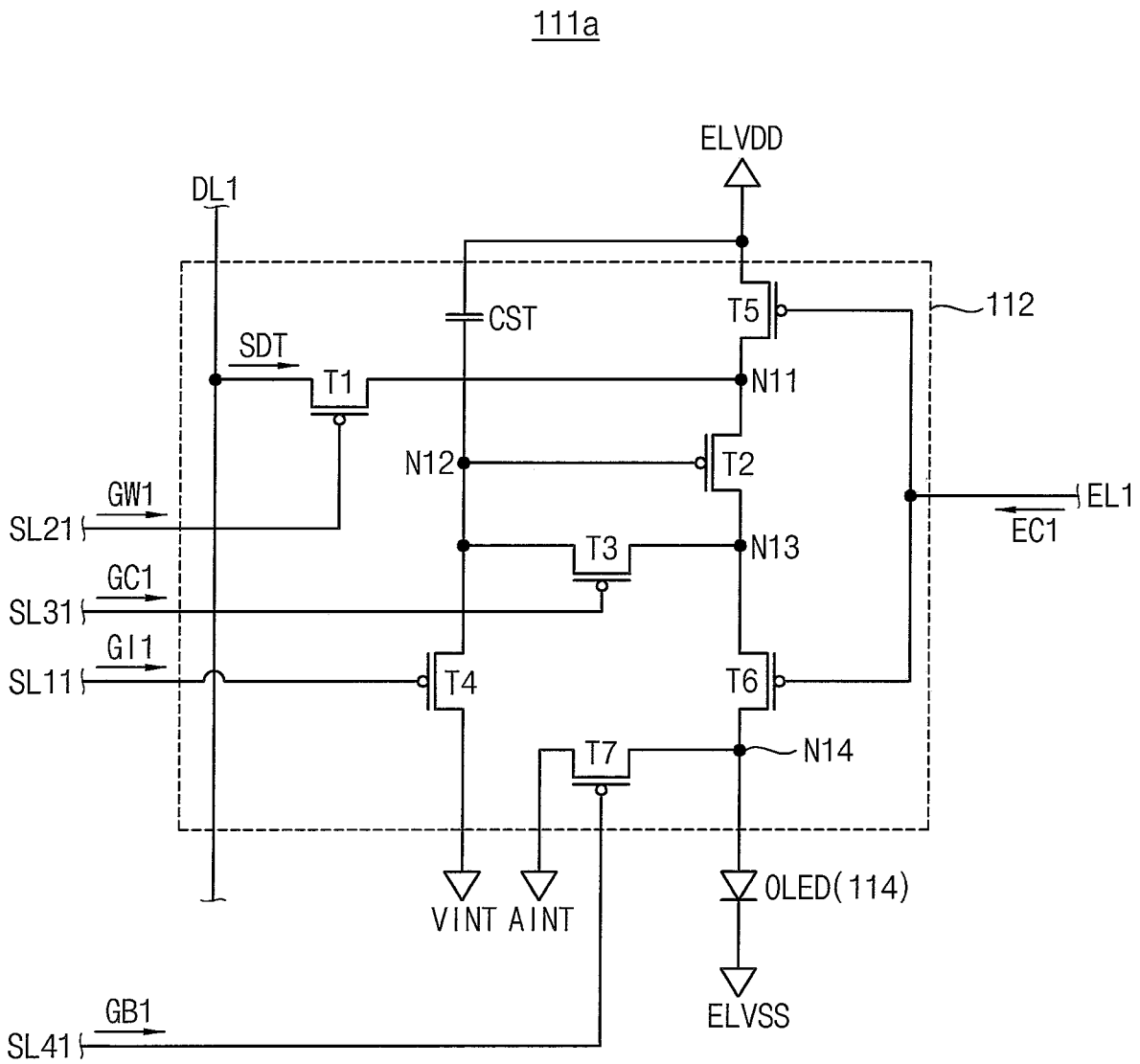
FIG. 4 is a circuit diagram illustrating an example of the pixel of FIG. 3 according to example embodiments.

FIG. 4 is a circuit diagram illustrating an example of the pixel of FIG. 3 according to example embodiments.

In FIG. 3, a pixel 111 is coupled to a first scan line set SLS1, a first data line DL1 and a first emission control line EL1. According to an example embodiment, the first scan line set SLS1 includes a first scan line SL11, a second scan line SL21, a third scan line SL31 and a fourth scan line SL41.

Referring to FIG. 4, a pixel 111*a* may include a pixel circuit 112 and an OLED 114. The pixel circuit 112 may include a switching transistor T1, a driving transistor T2, a compensation transistor T3, a first initialization transistor T4, first and second emission transistors T5 and T6, a second initialization transistor T7 and a storage capacitor CST.

The switching transistor T1 may include a p-channel metal-oxide semiconductor (PMOS) transistor that has a first electrode coupled to the data line DL1 to receive a data voltage SDT, a gate electrode coupled to the second scan line SL21 to receive a second scan signal GW1 and a second electrode coupled to a first node N11. The driving transistor T2 may include a PMOS transistor that has a first electrode coupled to a first node N11, a gate electrode coupled to a second node N12 and a second electrode coupled to a third node N13.

The compensation transistor T3 may include a PMOS transistor that has a gate electrode coupled to the third can line SL31 to receive a third scan signal GC1, a first electrode coupled to the second node N12 and a second electrode coupled to the third node N13. The first initialization transistor T4 may include a PMOS transistor that has a gate coupled to the first scan line SL11 to receive a first scan signal GI1, a first electrode coupled to the second node N12 and a second electrode receiving the first initialization voltage VINT.

The first emission transistor T5 may include a PMOS transistor that has a first electrode coupled to the high power supply voltage ELVDD, a second electrode coupled to the first node N11 and a gate electrode coupled to the first emission control line EL1 to receive the first emission control signal EC1. The second emission transistor T6 may include a PMOS transistor that has a first electrode coupled to the third node N13, a second electrode coupled to the fourth node N14 and a gate electrode coupled to the first emission control line EL1 to receive the first emission control signal EC1.

The second initialization transistor T7 may include a PMOS transistor that has a gate coupled to the fourth scan line SL41 to receive a fourth scan signal GB1, a first electrode receiving the second initialization voltage AINT and a second electrode coupled to the fourth node N14.

The storage capacitor CST may have a first terminal coupled to the high power supply voltage ELVDD and a second terminal coupled to the second node N12. The OLED 114 may have an anode coupled to the fourth node N14 and a cathode coupled to the low power supply voltage ELVSS.

The switching transistor T1 transfers the data voltage SDT to the storage capacitor CST in response to the second scan signal GW1 and the OLED 114 may emit light in response to the data voltage SDT stored in the storage capacitor CST to display image.

The emission transistors T5 and T6 are turned-on or turned-off in response to the first emission control signal EC1 to provide a current to the OLED 114 or to intercept a current from the OLED 114. When the current is intercepted from the OLED 114, the OLED 114 does not emit. Therefore, the emission transistors T5 and T6 are turned on or turned off in response to the first emission control signal EC1 to adjust a luminance of the display panel 110.

The compensation transistor T3 may connect the second node N12 and the third node N13 in response to the third scan signal GC1. That is, the compensation transistor T3 may compensate for variance of threshold voltage of each driving transistor of each pixel 111 when the image is displayed by diode-connecting the gate electrode and the second electrode of the driving transistor T2.

The first initialization transistor T4 may transfer the first initialization voltage VINT to the second node N12 in response to the first scan signal GI1. The first initialization transistor T4 may initialize data voltage transferred to the driving transistor T2 during a previous frame by transferring the initialization voltage VINT to the gate electrode of the driving transistor T2. The second initialization transistor T7 may transfer the second initialization voltage AINT to the fourth node N14 in response to the fourth scan signal GB1 to discharge parasitic capacitance between the second emission transistor T6 and the OLED 114.

Figure 5:
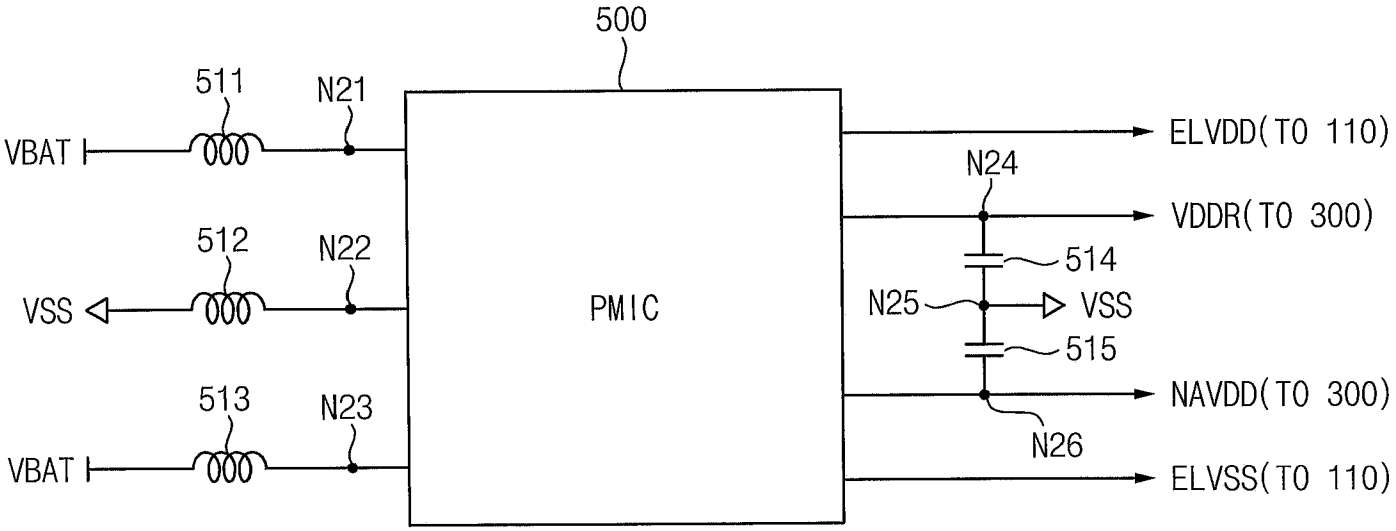
FIG. 5 is a block diagram illustrating an example of the PMIC in the mobile device of FIG. 1 according to example embodiments.

FIG. 5 is a block diagram illustrating an example of the PMIC in the mobile device of FIG. 1 according to example embodiments.

Referring to FIG. 5, the PMIC 500 is coupled to an inductor 511 receiving the battery voltage VBAT at a node N21, is coupled to an inductor 512 coupled to a ground voltage VSS at a node N22, and is coupled to an inductor 513 receiving the battery voltage VBAT at a node N23.

The PMIC 500 may generate the high power supply voltage ELVDD and the first driving voltage VDDR based on the battery voltage VBAT, may provide the high power supply voltage ELVDD to the display panel 110 and provide the first driving voltage VDDR to the voltage generator 300.

The PMIC 500 may generate the low power supply voltage ELVSS based on the battery voltage VBAT, and may provide the low power supply voltage ELVSS to the display panel 110.

A capacitor 514 may be coupled between a node N24 connected to the PMIC 500 and a node N25 connected to a ground voltage VSS and may store charges generated by the first driving voltage VDDR.

The PMIC 500 may generate the second driving voltage NAVDD based on the battery voltage VBAT and may provide the second driving voltage NAVDD to the voltage generator 300.

A capacitor 515 may be coupled between a node N26 connected to the PMIC 500 and the node N25 connected to the ground voltage VSS and may store charges generated by the second driving voltage NAVDD.

Figure 6:
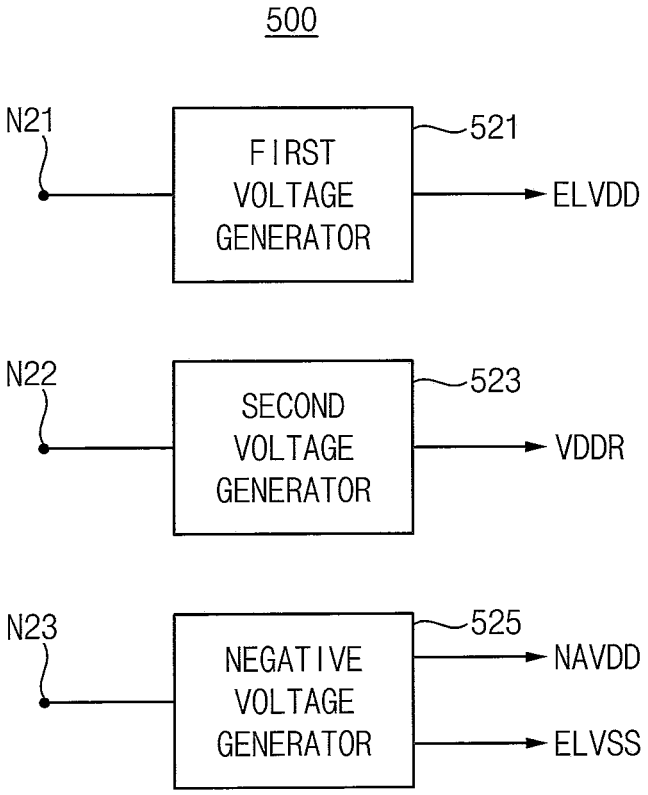
FIG. 6 is a block diagram illustrating an example of the PMIC of FIG. 5 according to example embodiments.

FIG. 6 is a block diagram illustrating an example of the PMIC of FIG. 5 according to example embodiments.

Referring to FIG. 6, the PMIC 500 may include a first voltage generator 521, a second voltage generator 523 and a third voltage generator 525.

The first voltage generator 521 is connected to the node N21 and generates the high power supply voltage ELVDD based on the battery voltage VBAT stored in the inductor 511 (in FIG. 5). The second voltage generator 523 is connected to the node N23 and generates the first driving voltage VDDR based on the battery voltage VBAT stored in the inductor 513 (in FIG. 5). The third voltage generator 525 is connected to the node N22 and generates the second driving voltage NAVDD and the low power supply voltage ELVSS based on the ground voltage VSS stored in the inductor 512 (FIG. 5).

Figure 7:
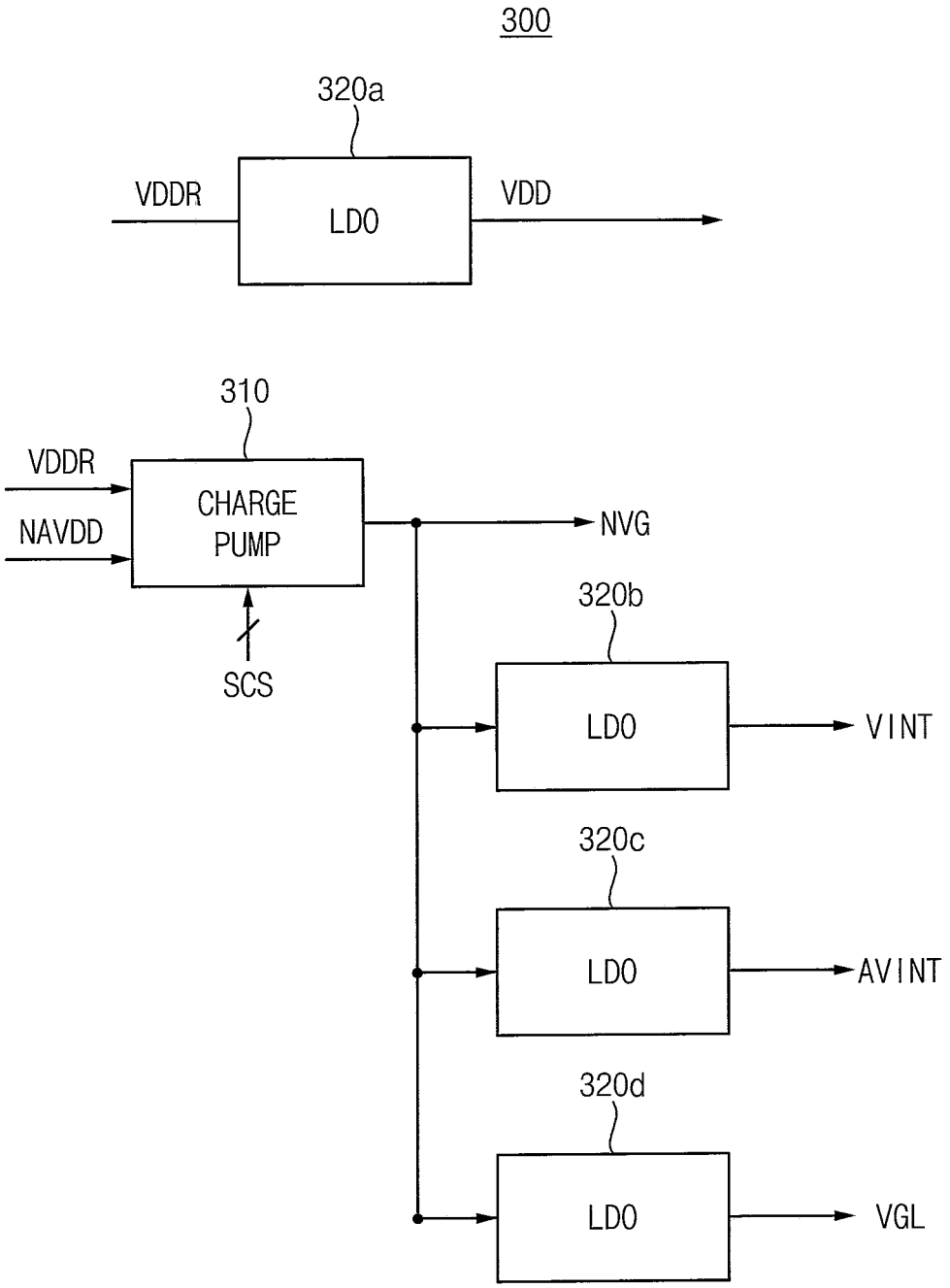
FIG. 7 illustrates an example of the voltage generator in the OLED device in FIG. 1 according to example embodiments.

FIG. 7 illustrates an example of the voltage generator in the OLED device in FIG. 1 according to example embodiments.

Referring to FIG. 7, the voltage generator 300 may include a charge pump 310 and first through fourth LDO regulators 320*a*, 320*b*, 320*c* and 320*d*.

The charge pump 310 may generate the negative voltage NVG based on the first driving voltage VDDR, the second driving voltage NAVDD and switching control signals SCS.

The first LDO regulator 320*a* may generate the first operating voltage VDD based on the first driving voltage VDDR. Each of the second through fourth LDO regulators 320*b*, 320*c* and 320*d* may generate respective one of the first initialization voltage VINT and the second initialization voltage AVINT and the second operating voltage VGL based on the negative voltage NVG.

The switching control signals SCS may be included in the power control signal PCTL in FIG. 1 or the timing controller 130 may provide the switching control signals SCS to the voltage generator 300.

Figure 8:
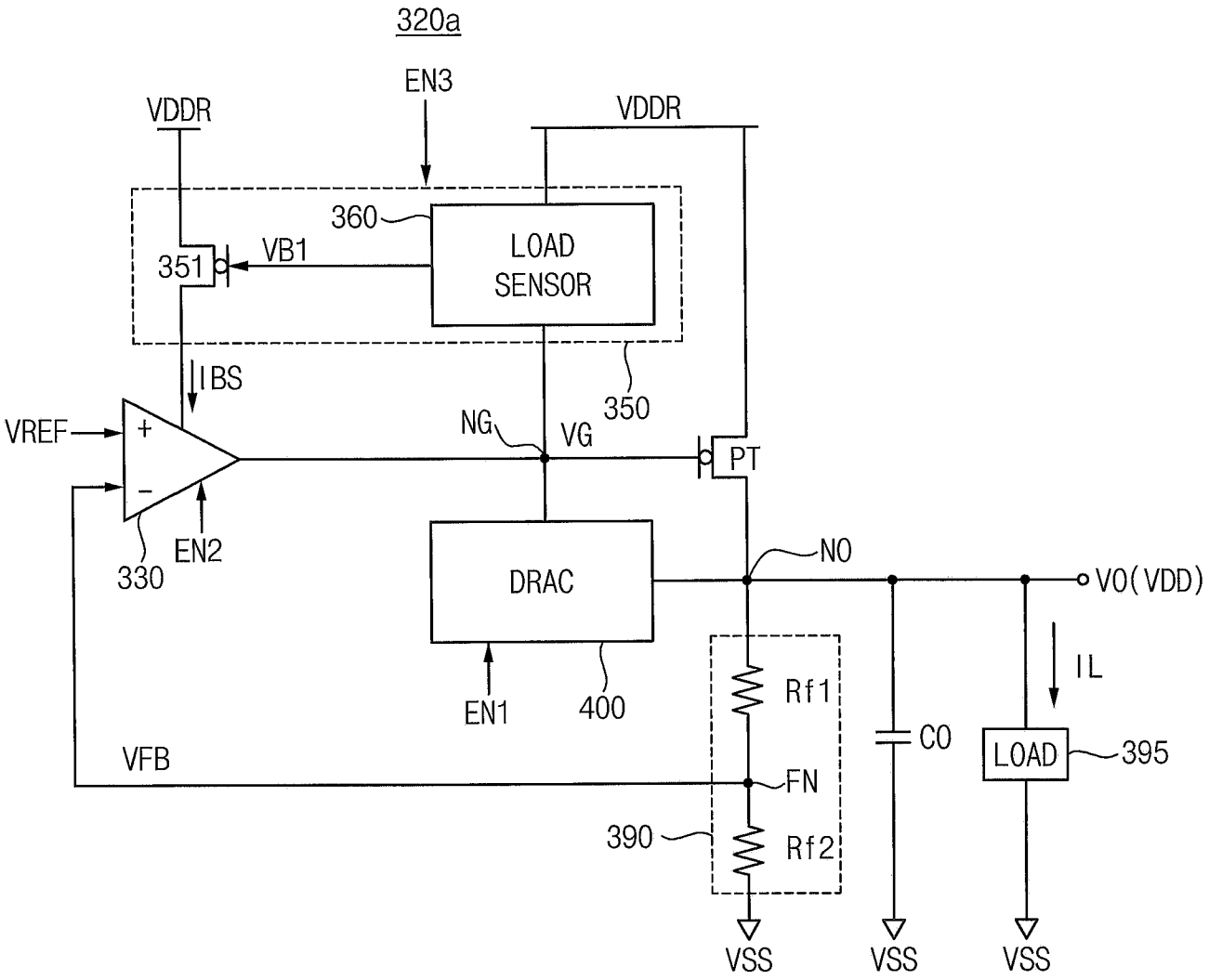
FIG. 8 is a block diagram illustrating an example of the first LDO regulator in the voltage generator of FIG. 7 according to example embodiments.

FIG. 8 is a block diagram illustrating an example of the first LDO regulator in the voltage generator of FIG. 7 according to example embodiments.

Each of the second through fourth LDO regulators 320*b*, 320*c* and 320*d* in FIG. 7 may have a similar configuration with the first LDO regulator of FIG. 8.

Referring to FIG. 8, the first LDO regulator 320*a* may include a power transistor PT, an error amplifier 330, an adaptive bias circuit 350, a feedback circuit 390 and a droop adjusting circuit DARC 400.

In FIG. 8, an output capacitor CO and a load 395 are also illustrated for convenience of explanation. The output capacitor CO is connected between an output node NO and the ground voltage VSS and the load 395 is connected between the output node NO and the ground voltage VSS in parallel with the output capacitor CO. A load current IL may flow into the load 395 from the output node NO.

The power transistor PT may include a p-channel metal-oxide semiconductor (PMOS) transistor that includes a source coupled to the first driving voltage (also referred to as a driving voltage) VDDR, a gate coupled to a gate node NG and a drain coupled to the output node NO. The power transistor PT may regulate the driving voltage VDDR based on a gate voltage VG of the gate node NG to provide an output voltage VO at the output node NO. The output voltage VO may correspond to the first operating voltage VDD and the first operating voltage VDD may be also referred to as an operating voltage.

The error amplifier 330 may receive a reference voltage VREF and a feedback voltage VFB proportional to the output voltage VO and may output the gate voltage VG at the gate node NG by amplifying a voltage difference between the reference voltage VREF and the feedback voltage VFB. The error amplifier 330 may include a positive input terminal to receive the reference voltage VREF, a negative input terminal to receive the feedback voltage VFB and an output terminal coupled to the gate node NG.

As will be described with reference to FIG. 9, the error amplifier 330 may include a resistive common-mode feedback circuit which is activated in response to an enable signal EN2 and increases an impedance of the error amplifier 330.

The adaptive bias circuit 350 may be connected to the driving voltage VDDR, the gate node NG and the error amplifier 330. The adaptive bias circuit 350 may copy a supply current provided to the output node NO through the power transistor PT based on the gate voltage VG to generate a first current proportional to the supply current and may adjust a bias current IBS provided to the error amplifier 330 based on the first current. The adaptive bias circuit 350 may be selectively activated in response to an enable signal EN3.

The adaptive bias circuit 350 may include a first PMOS transistor 351 and a load sensor 360. The first PMOS transistor 351 may be connected between the driving voltage VDDR and the error amplifier 330. The load sensor 360 may be connected between the driving voltage VDDR and the gate node NG.

The first PMOS transistor 351 may have a source coupled to the driving voltage VDDR, a gate receiving the first bias voltage VB1 and a drain which is coupled to the error amplifier 330 and provides the bias current IBS to the error amplifier 330. The load sensor 360 may generate the first current by coping the supply current provided to the output node NO through the power transistor PT in response to the gate voltage VG, may generate the first bias voltage VB1 based on the first current and may provide the first bias voltage VB1 to the gate of the first PMOS transistor 351.

The droop adjusting circuit 400 may be connected between the gate node NG and the output node NO, may be coupled to the output voltage VO and may adjust the gate voltage VG to compensate for a change of the output voltage VO based on a change of the load current IL which is provided to the load 395 from the output node NO. The droop adjusting circuit 400 may reduce a voltage level of the gate voltage VG in response to decrease of the output voltage VO. The droop adjusting circuit 400 may be selectively activated in response to an enable signal EN1.

The feedback circuit 390 may connected between the output node NO and the ground voltage VSS, may generate the feedback voltage VFB by dividing the output voltage VO and may provide the feedback voltage VFB to the error amplifier 330. The feedback circuit 390 may include a first feedback resistor Rf1 and a second feedback resistor Rf2 which are connected in series between the output node NO and the ground voltage VSS. The first feedback resistor Rf1 is connected between the output node NO and a feedback node FN and the second feedback resistor Rf2 is connected between the feedback node FN and the ground voltage VSS.

The enable signals EN1, EN2 and EN3 may be included in the be included in the power control signal PCTL in FIG. 1 or the timing controller 130 may provide the enable signals EN1, EN2 and EN3 to the voltage generator 300. The output voltage VO may be provided as the (first) operating voltage VDD.

Figure 9:
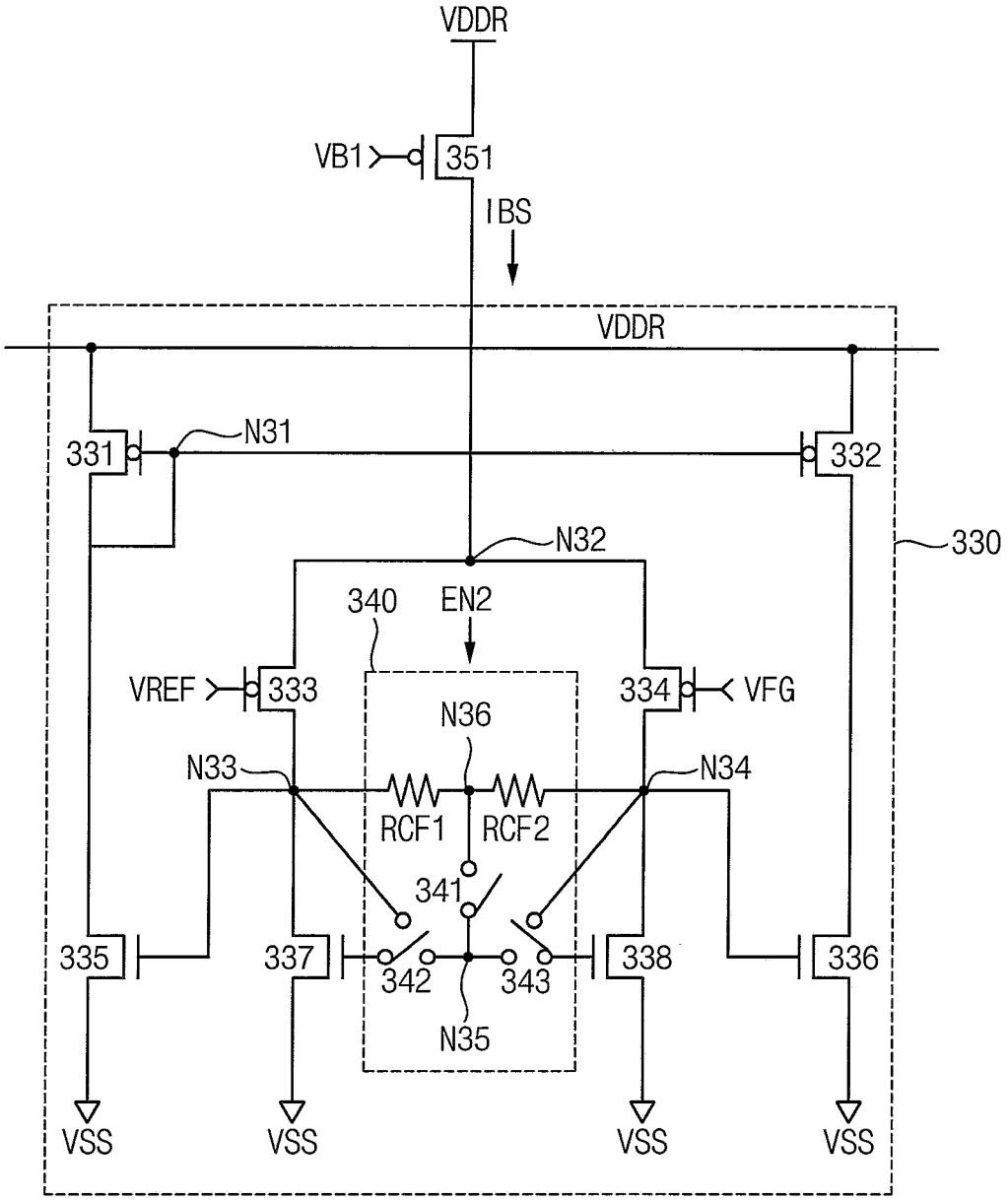
FIG. 9 is a circuit diagram illustrating an example of the error amplifier in the LDO regulator of FIG. 8 according to example embodiments.

FIG. 9 is a circuit diagram illustrating an example of the error amplifier in the LDO regulator of FIG. 8 according to example embodiments.

In FIG. 9, the first PMOS transistor 351 in the adaptive bias circuit 350 is also illustrated for convenience of explanation.

Referring to FIG. 9, the error amplifier 330 may include first through fourth PMOS transistors 331, 332, 333 and 334, first through fourth n-channel metal-oxide semiconductor (NMOS) transistors 335, 336, 337 and 338 and a resistive common mode feedback circuit 340.

The first PMOS transistor 331 may include a source coupled to the driving voltage VDDR, a gate coupled to a first node N31 and a drain coupled to the first node N31. The second PMOS transistor 332 may include a source coupled to the driving voltage VDDR, a gate coupled to a first node N31 and a drain coupled to the gate node NG. Therefore, the first PMOS transistor 331 and the second PMOS transistor 332 may constitute a current mirror.

The third PMOS transistor 333 may include a source coupled to a second node N32 receiving the bias current IBS, a gate receiving the reference voltage VREF and a drain coupled to a third node N33. The fourth PMOS transistor 334 may include source coupled to the second node N32, a gate receiving the feedback voltage VFB and a drain coupled to a fourth node N34.

The first NMOS transistor 335 may include a drain coupled to the first node N31, a gate coupled to the third node N33 and a source coupled to the ground voltage VSS. The second NMOS transistor 336 may include a drain coupled to the gate node NG, a gate coupled to the fourth node N34 and a source coupled to the ground voltage VSS. The third NMOS transistor 337 may include a drain coupled to the third node N33, a gate coupled to a fifth node N35 and a source coupled to the ground voltage VSS. The fourth NMOS transistor 338 may include a drain coupled to the fourth node N34, a gate coupled to the fifth node N35 and a source coupled to the ground voltage VSS.

The resistive common mode feedback circuit 340 may be connected to the third node N33, the fourth node N34 and the fifth node N35 and may selectively increase an impedance of the error amplifier 330 in response to the enable signal EN2.

The resistive common mode feedback circuit 340 may include a first resistor RCF1, a second resistor RCF2, a first switch 341, a second switch 342 and a third switch 343. The first resistor RCF1 and the second resistor RCF2 may have a same resistance. The first resistor RCF1 may be connected between the third node N32 and a sixth node N36 and the second resistor RCF2 may be connected between the fourth node N34 and the sixth node N36.

The first switch 341 may selectively connect the fifth node N35 and the sixth node N36 in response to the enable signal EN2. The second switch 342 may connect the gate of the third NMOS transistor 337 to one of the third node N33 and the fifth node N35 in response to the enable signal EN2. The third switch 343 may connect the gate of the fourth NMOS 338 transistor to one of the fourth node N34 and the fifth node N35 in response to the enable signal EN2.

In response to the enable signal EN2 having a first logic level, the resistive common mode feedback circuit 340 may increase the impedance of the error amplifier 330 by the first switch 341 connecting the fifth node N35 to the sixth node N36, the second switch 342 connecting the gate of the third NMOS transistor 337 to the fifth node N35 and the third switch 343 connecting the gate of the fourth NMOS transistor 338 to the fifth node N35.

A voltage difference may occur between the third node N33 and the fourth node N34 because currents provided to each of the third node N33 and the fourth node N34 from the second node N32 differ based on a difference between the reference voltage VREF and the feedback voltage VFB, currents sinking to the ground voltage VSS through each of the first NMOS transistor 335 and the second NMOS transistor 336 differ due the voltage difference, and thus, the gate voltage VG of the gate node NG may have a voltage level corresponding to the voltage difference between the reference voltage VREF and the feedback voltage VFB.

In addition, because an impedance is generated between the third node N33 and the fourth node N34 by the first resistor RCF1 and the second resistor RCF2 due to the voltage difference, the impedance of the error amplifier 330 may increase more than an impedance of the error amplifier 330 in case that the first switch 341 disconnects the fifth node N35 and the sixth node N36, the second switch 342 connects the gate of the third NMOS transistor 337 to the third node N33 and the third switch 343 connects the gate of the fourth NMOS transistor 338 to the fourth node N34.

Figure 10:
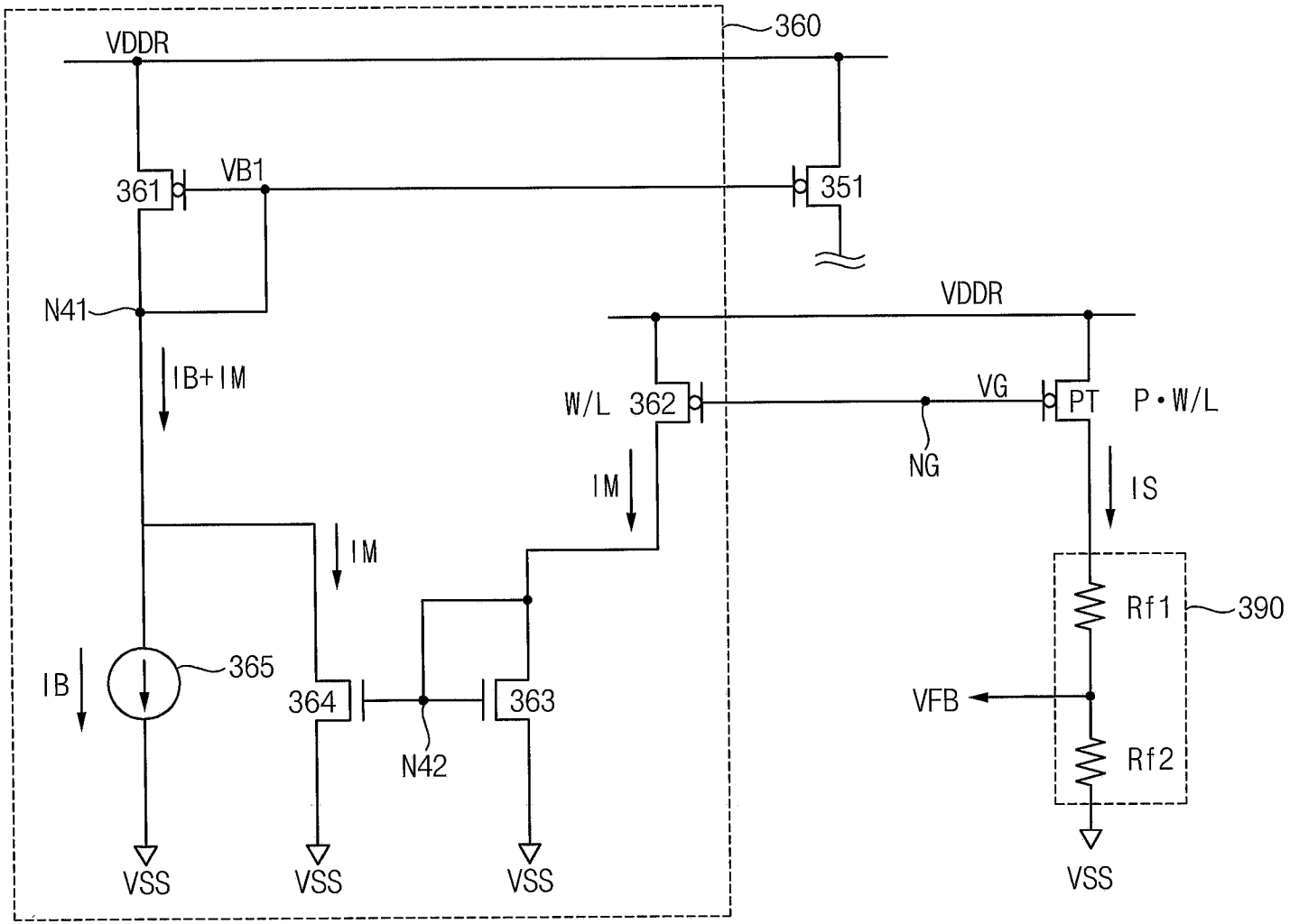
FIG. 10 is a circuit diagram illustrating an example of the load sensor in the adaptive bias circuit in FIG. 8 according to example embodiments.

FIG. 10 is a circuit diagram illustrating an example of the load sensor in the adaptive bias circuit in FIG. 8 according to example embodiments.

In FIG. 10, the first PMOS transistor 351 in the adaptive bias circuit 350, the power transistor PT and the feedback circuit 390 are also illustrated for convenience of explanation.

Referring to FIG. 10, the load sensor 360 may generate a first current IM by coping a supply current IS provided to the output node NO through the power transistor PT in response to the gate voltage VG, may generate the first bias voltage VB1 based on the first current IM and may provide the first bias voltage VB1 to the gate of the first PMOS transistor 351.

The load sensor 360 may include a second PMOS transistor 361, a third PMOS transistor 362, a first NMOS transistor 363, a second NMOS transistor 364 and a current source 365.

The second PMOS transistor 361 may include a source coupled to the driving voltage VDDR, a gate coupled to a first node N41 coupled to the gate of the first PMOS transistor 351 and a drain coupled to the first node N41. Therefore, the first PMOS transistor 351 and the second PMOS transistor 361 may constitute a current mirror.

The third PMOS transistor 362 may include a source coupled to the driving voltage VDDR, a gate coupled to the gate node NG and a drain coupled to a second node N42. The third PMOS transistor 362 may generate the first current IM by coping the supply current IS provided to the output node NO through the power transistor PT in response to the gate voltage VG and may provide the first current IM to the second node N42. A ratio W/L of channel width over a channel length of the third PMOS transistor 362 correspond to 1/P of a ratio P·W/L of channel width over a channel length of the power transistor PT and P is a real number greater than one. Therefore, a magnitude of the first current IM corresponds 1/P of a magnitude of the supply current IS.

The first NMOS transistor 363 may include a drain coupled to the second node N42, a gate coupled to the second node N42 and a source coupled to the ground voltage VSS. The second NMOS transistor 364 may include a drain coupled to the first node N41, a gate coupled to the second node N42 and a source coupled to the ground voltage VSS. Therefore, the second NMOS transistor 364 and the first NMOS transistor 363 may constitute a current mirror.

The current source 365 may be connected between the first node N41 and the ground voltage VSS, and may sink a second current IB to the ground voltage VSS.

When the first current IM flows to the second node N42 from the second PMOS transistor 362, the first current IM flows through the second NMOS transistor 364 because the second NMOS transistor 364 and the first NMOS transistor 363 constitutes a current mirror. Therefore, a current corresponding to a sum of the first current IM and the second current IB flows from the second PMOS transistor 361, the first bias voltage VB1 corresponding to the sum of the first current IM and the second current IB is applied to the gate of the first PMOS transistor 351 and the first PMOS transistor 351 provides the second node N32 of the error amplifier 330 with the bias current IBS corresponding to the sum of the first current IM and the second current IB.

Figure 11:
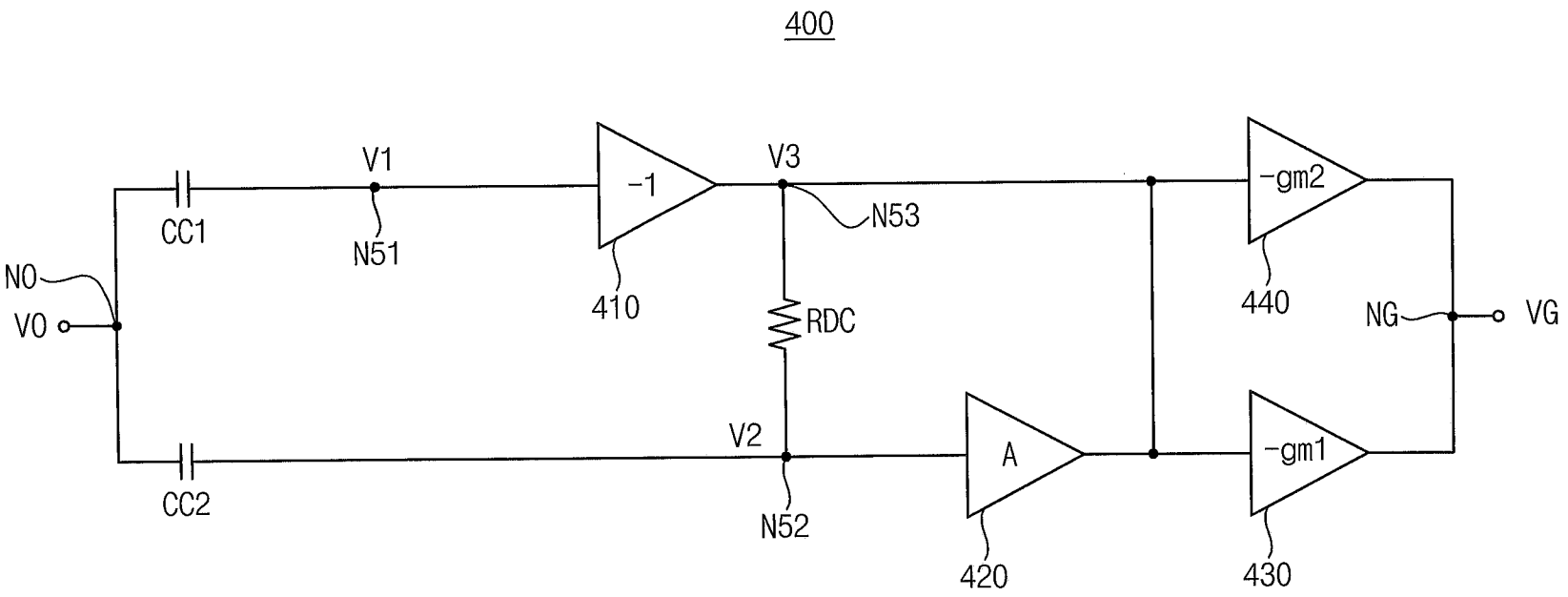
FIG. 11 is a block diagram illustrating an example of the droop adjusting circuit in the LDO regulator of FIG. 8 according to example embodiments.

FIG. 11 is a block diagram illustrating an example of the droop adjusting circuit in the LDO regulator of FIG. 8 according to example embodiments.

Referring to FIG. 11, the droop adjusting circuit 400 may include a first coupling capacitor CC1, a second coupling capacitor CC2, a buffer 410, a adjusting resistor RDC, an amplifier 420, a first transconductance amplifier 430 and a second transconductance amplifier 440.

The first coupling capacitor CC1 may be connected between the output node NO and a first node N51 and may couple the output voltage VO to the first node N51. The second coupling capacitor CC2 may be connected between the output node NO and a second node N52 and may couple the output voltage VO to the second node N52.

The buffer 410 may be connected between the first node N51 and a third node N53, and may invert a first voltage V1 of the first node N51. The buffer 410 may have a gain of −1. The adjusting resistor RDC may be connected between the third node N53 and the second node N52. The amplifier 420 may be connected between the second node N52 and the third node N53, and may amplify a second voltage V2 of the second node N52 with a positive gain A. The amplifier 420 may have an output terminal connected to the third node N53.

The first transconductance amplifier 430 may be connected between the third node N53 and the output node NO, and may amplify an average voltage with a first negative gain −gm1. The average voltage may be obtained by averaging an output of the amplifier 420 and a third voltage V3 of the third node N53. The second transconductance amplifier 440 may be connected between the third node N53 and the output node NO in parallel with the first transconductance amplifier 430, and may amplify the average voltage with a second negative gain −gm2. Therefore, the gate voltage VG at the gate node NG may correspond to sum of an output of the first transconductance amplifier 430 and an output of the second transconductance amplifier 440.

Therefore, in response to a decrease of the output voltage VO, the first coupling capacitor CC1 decreases the first voltage V1, the second coupling capacitor CC2 decreases the second voltage V2, the buffer 410 increases the third voltage V3 in response to a decrease of the first voltage V1, the amplifier 420 amplifies the second voltage by the positive gain A, the first transconductance amplifier 430 amplifies the average voltage by the first negative gain −gm1, and the second transconductance amplifier 440 amplifies the average voltage by the second negative gain −gm2. A first output of the first transconductance amplifier 430 and a second output of the second transconductance amplifier 440 are summed at the gate node NG and are provided as the gate voltage VG. Therefore, the gate voltage VG decreases in response to a decrease of the output voltage VO, a current provided to the output node NO through the power transistor PT increases in response to the decrease of the gate voltage VG and a voltage level of the output voltage VO increases.

Figure 12:
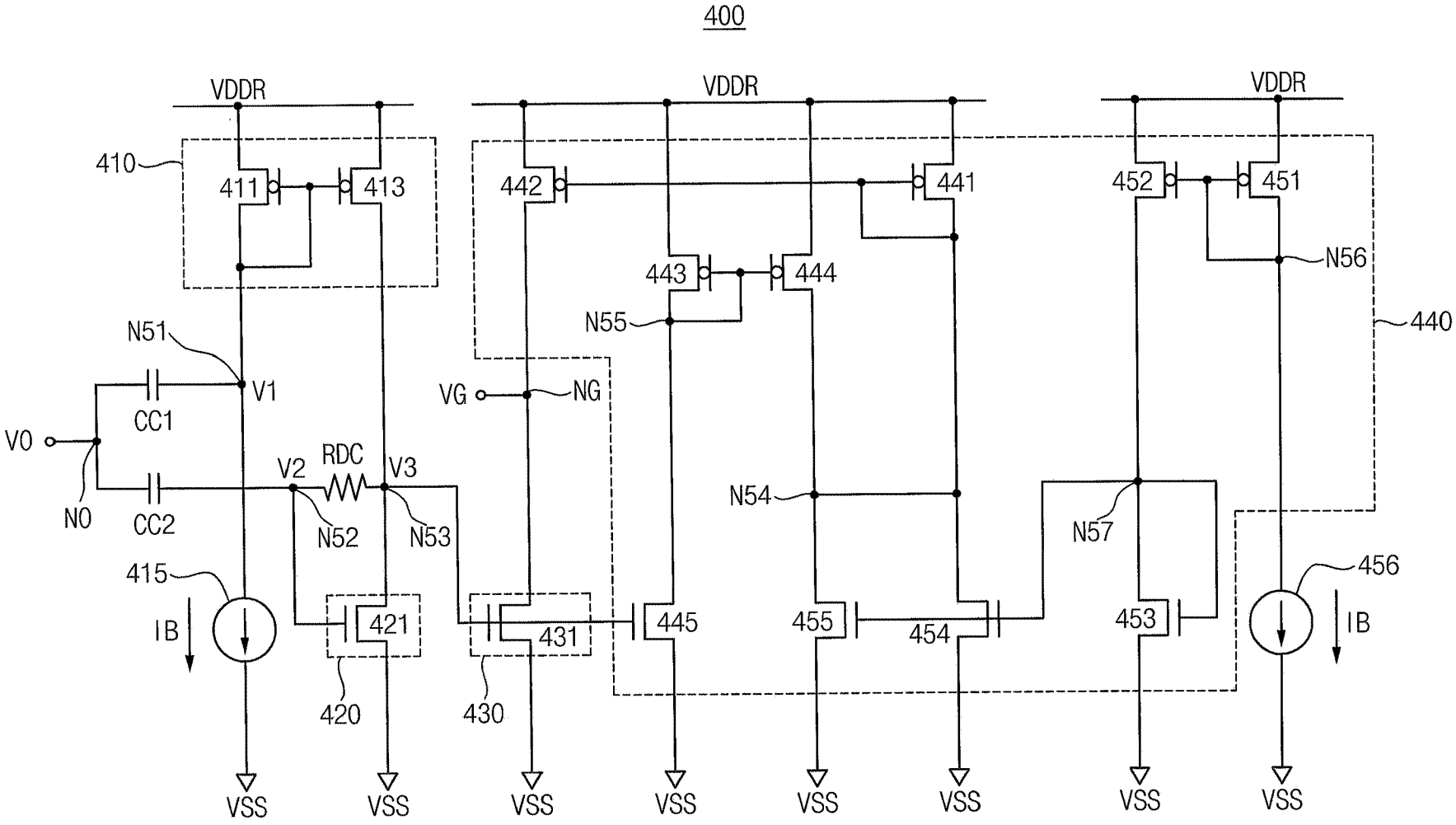
FIG. 12 is a circuit diagram illustrating the droop adjusting circuit of FIG. 11 according to example embodiments.

FIG. 12 is a circuit diagram illustrating the droop adjusting circuit of FIG. 11 according to example embodiments.

Referring to FIGS. 11 and 12, the buffer 410 may include a first PMOS transistor 411 and a second PMOS transistor 413.

The first PMOS transistor 411 may include a source coupled to the driving voltage VDDR, a gate coupled to the first node N51 and a drain coupled to the first node N51. The second PMOS transistor 413 may include source coupled to the driving voltage VDDR, a gate coupled to the first node N51 and a drain coupled to the third node N53. Therefore, the first PMOS transistor 411 and the second PMOS transistor 413 may constitute a current mirror. Accordingly, the second PMOS transistor 413 may increase a voltage level of the third voltage V3 by increasing a current provided to the third node N53 in response to a decrease of the first voltage V1 responding to the decrease of the output voltage VO.

The amplifier 420 may include an NMOS transistor 421 that includes a drain coupled to the third node N53, a gate coupled to the second node N53 and a source coupled to the ground voltage VS S. Therefore, the NMOS transistor 421 may reduce a current sinking to the ground voltage VSS from the third node N53 in response to a decrease of the second voltage V2 responding to the decrease of the output voltage VO.

The first transconductance amplifier 430 may include an NMOS transistor 431 that includes a drain coupled to the gate node NG, a gate coupled to the third node N53 and a source coupled to the ground voltage VSS. Therefore, the first transconductance amplifier 430 may increase a current sinking to the ground voltage VSS from the gate node NG in response to an increase of the third voltage V3 responding to the decrease of the output voltage VO.

The second transconductance amplifier 440 may include first through sixth PMOS transistors 441, 442, 443, 444, 451 and 452 and first through fourth NMOS transistors 445, 453, 454, and 455.

The first PMOS transistor 441 may include a source coupled to the driving voltage VDDR, a gate coupled to a fourth node N54 and a drain coupled to the fourth node N54. The second PMOS transistor 442 may include a source coupled to the driving voltage VDDR, a gate coupled to the fourth node N54 and a drain coupled to the gate node NG. Therefore, the first PMOS transistor 441 and the second PMOS transistor 442 may constitute a current mirror.

The third PMOS transistor 443 may include a source coupled to the driving voltage VDDR, a gate coupled to a fifth node N55 and a drain coupled to the fifth node N55. The third PMOS transistor 444 may include a source coupled to the driving voltage VDDR, a gate coupled to the fifth node N55 and a drain coupled to the fourth node N54. Therefore, the third PMOS transistor 443 and the fourth PMOS transistor 444 may constitute a current mirror.

The first NMOS transistor 445 may include a drain coupled to the fifth node N55, a gate coupled to the third node N53 and a source coupled to the ground voltage VSS.

The fifth PMOS transistor 451 may include a source coupled to the driving voltage VDDR, a gate coupled to a sixth node N56 and a drain coupled to the sixth node N56. The sixth PMOS transistor 452 may include a source coupled to the driving voltage VDDR, a gate coupled to the sixth node N56 and a drain coupled to a seventh node N57. Therefore, the fifth PMOS transistor 451 and the sixth PMOS transistor 452 may constitute a current mirror.

The second NMOS transistor 453 that includes a drain coupled to the seventh node N57, a gate coupled to the seventh node N57 and a source coupled to the ground voltage VSS. The third NMOS transistor 454 may include a drain coupled to the fourth node N54, a gate coupled to the seventh node N57 and a source coupled to the ground voltage VSS. The fourth NMOS transistor 455 may include a drain coupled to the fourth node N54 in parallel with the third NMOS transistor 454, a gate coupled to the seventh node N57 and a source coupled to the ground voltage VSS. The current source 415 is connected between the first node N51 and the ground voltage VSS and sinks the second current IB to the ground voltage VSS and a current source 456 is connected between the sixth node N56 and the ground voltage VSS and sinks the second current IB to the ground voltage VSS.

Figure 13:
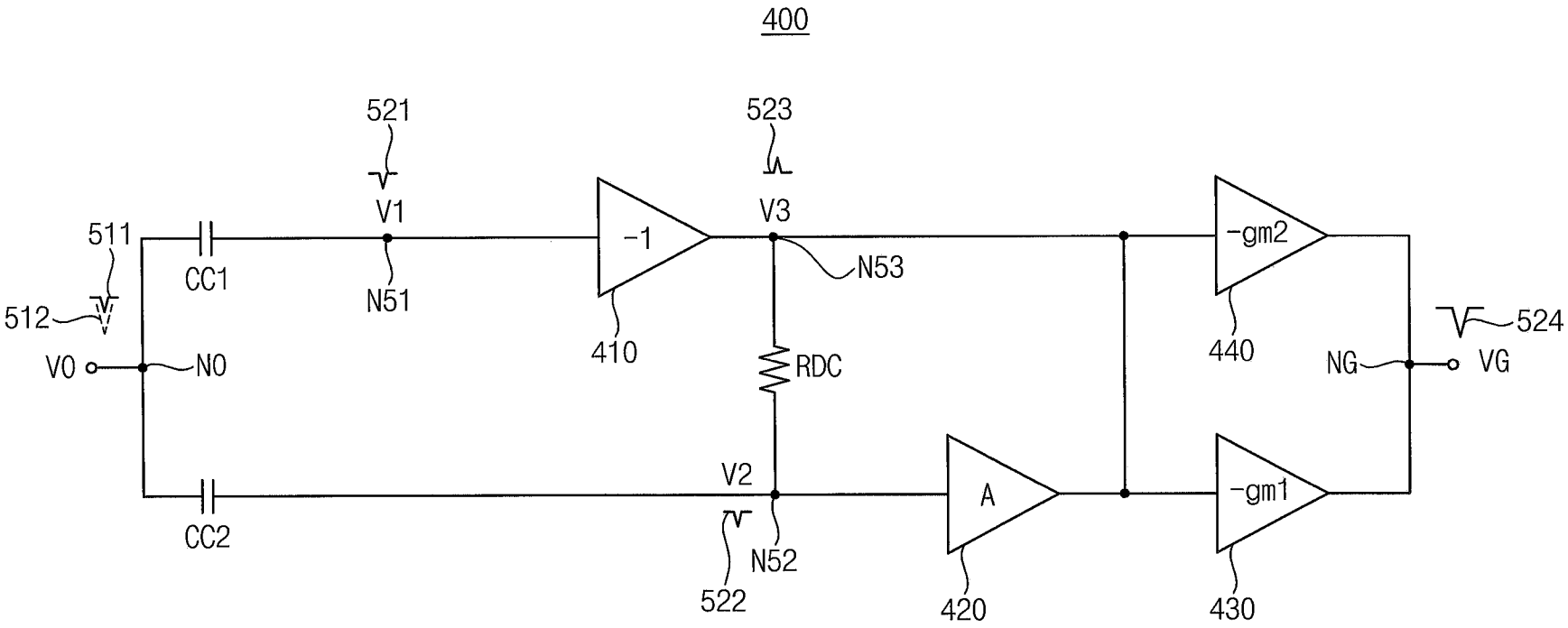
FIG. 13 illustrates an operation of the droop adjusting circuit of FIG. 11 according to example embodiments.

FIG. 13 illustrates an operation of the droop adjusting circuit of FIG. 11 according to example embodiments.

Referring to FIG. 13, when the output voltage VO decreases as a reference numeral 511 indicates, the first voltage V1 decreases by the first coupling capacitor CC1 as a reference numeral 521 indicates and the second voltage V2 decreases by the second coupling capacitor CC2 as a reference numeral 522 indicates. In addition, the third voltage V3 increases by the buffer 410 as a reference numeral 523 indicates, the amplifier 420 amplifies the second voltage V2. The first transconductance amplifier 430 and the first transconductance amplifier 430 amplify the average voltage by respective one of negative gains, and the gate voltage VG at the gate node NG decreases as a reference numeral 524 indicates because outputs of the first transconductance amplifier 430 and the first transconductance amplifier 430 are summed at the gate node NG. Therefore, the voltage level of the output voltage VO may increase.

In FIG. 13, a reference numeral 512 indicates that the output voltage VO decreases when the droop adjusting circuit 400 does not operate. It is noted that a decrease of the output voltage VO in case that the droop adjusting circuit 400 does not operate is greater than a decrease of the output voltage VO in case that the droop adjusting circuit 400 operates.

Figure 14:
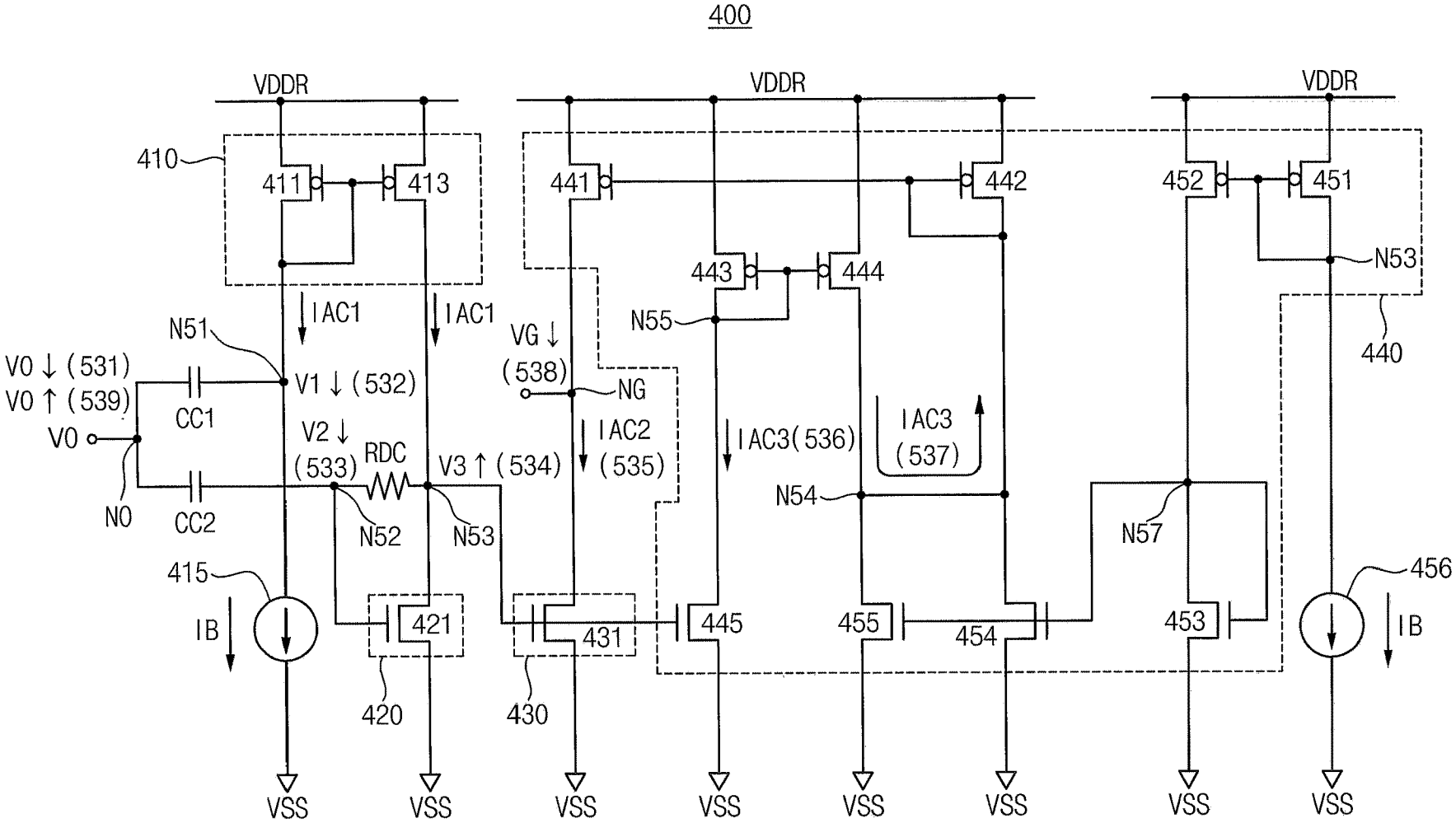
FIG. 14 illustrates an operation of the droop adjusting circuit of FIG. 1 according to example embodiments.

FIG. 14 illustrates an operation of the droop adjusting circuit of FIG. 1 according to example embodiments.

Referring to FIG. 14, when the output voltage VO decreases as a reference numeral 531 indicates, the first voltage V1 and the second voltage V2 decrease as reference numerals 532 and 533 indicate. In response to the decrease of the first voltage V1, a current IAC1 flowing to the first node N51 through the PMOS transistor 411 increases and a current IAC1 flowing to the third node N53 through the PMOS transistor 413 increases. In response to the increase of the current IAC1, the third voltage V3 increases as a reference numeral 534 indicates.

In response to the increase of the third voltage V3, a current IAC2 sinking to the ground voltage VSS through the NMOS transistor 431 from the gate node NG increases as a reference numeral 535 indicates and a current IAC3 sinking to the ground voltage VSS through the NMOS transistor 445 from the fifth node N55 increases as a reference numeral 535 indicates. The current IAC3 is mirrored by the PMOS transistor 444 and the mirrored current IAC3 flows to the drain of the PMOS transistor 442 as a reference numeral 537 indicates, a voltage level of the fourth node N54 increases, and a gate voltage of the PMOS transistor 441 increases, and thus the gate voltage VG decreases as a reference numeral 538 indicates. In response to the decrease of the gate voltage VG, the voltage level of the output voltage VO increases as a reference numeral 539 indicates. Accordingly, the droop adjusting circuit 400 may compensate for decrease of the output voltage VO rapidly.

FIGS. 15A-15D illustrate a load current and output voltages in various situations in the LDO regulator according to example embodiments.

Figure 15A:
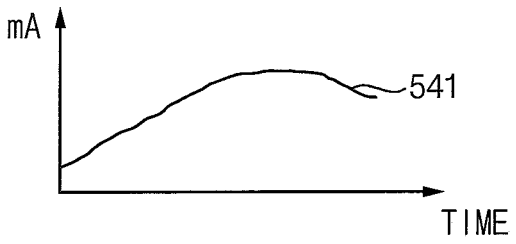
FIGS. 15A-15D illustrate a load current and output voltages in various situations in the LDO regulator according to example embodiments.
Figure 15B:
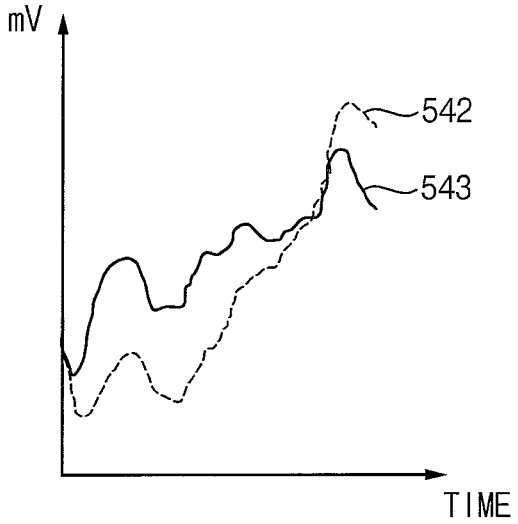
Figure 15C:
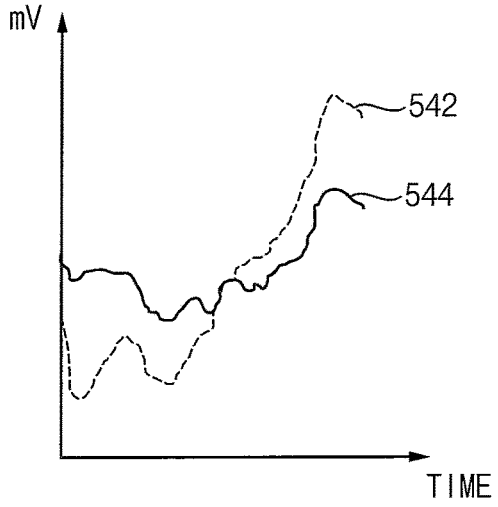
Figure 15D:
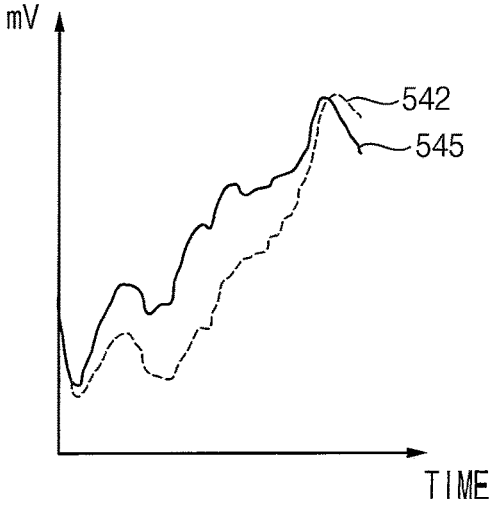

In FIG. 15A, a reference numeral 541 represents the load current IL provided to the load 395 in the LDO regulator 320*a* of FIG. 6. In FIG. 15B, a reference numeral 542 represents the output voltage VO in case that the resistive common mode feedback circuit 340 in the error amplifier 330, the adaptive bias circuit 350 and the droop adjusting circuit 400 are deactivated, and a reference numeral 543 represents the output voltage VO in case that the resistive common mode feedback circuit 340 is activated. In FIG. 15C, a reference numeral 542 represents the output voltage VO in case that the resistive common mode feedback circuit 340 in the error amplifier 330, the adaptive bias circuit 350 and the droop adjusting circuit 400 are deactivated, and a reference numeral 544 represents the output voltage VO in case that the droop adjusting circuit 400 is activated. In FIG. 15D, a reference numeral 542 represents the output voltage VO in case that the resistive common mode feedback circuit 340 in the error amplifier 330, the adaptive bias circuit 350 and the droop adjusting circuit 400 are deactivated, and a reference numeral 545 represents the output voltage VO in case that the adaptive bias circuit 350 is activated.

Referring to FIGS. 15A-15D, when the voltage level of the output voltage VO rapidly decreases in response to a rapid increase of the load current IL provided to the load 395, it is noted that the output voltage VO is efficiently recovered when the resistive common mode feedback circuit 340 in the error amplifier 330 or the adaptive bias circuit 350 is in operation and reduced level of the output voltage VO is rapidly recovered when the droop adjusting circuit 400 is in operation.

FIGS. 16A-16D illustrate a load current and output voltages in various situations in the LDO regulator according to example embodiments.

Figure 16A:
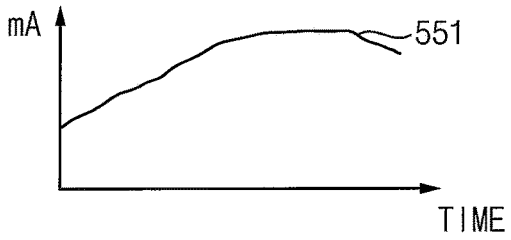
FIGS. 16A-16D illustrate a load current and output voltages in various situations in the LDO regulator according to example embodiments.
Figure 16B:
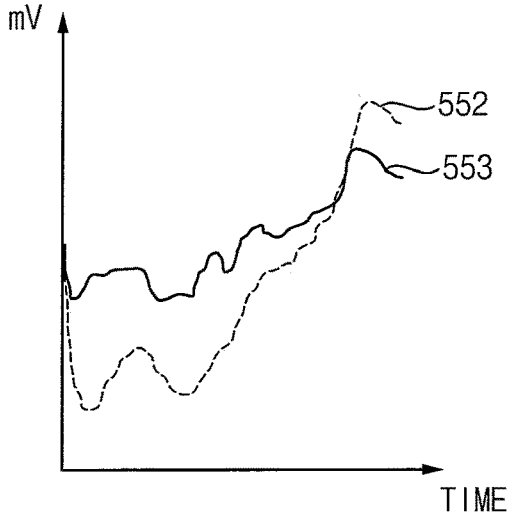
Figure 16C:
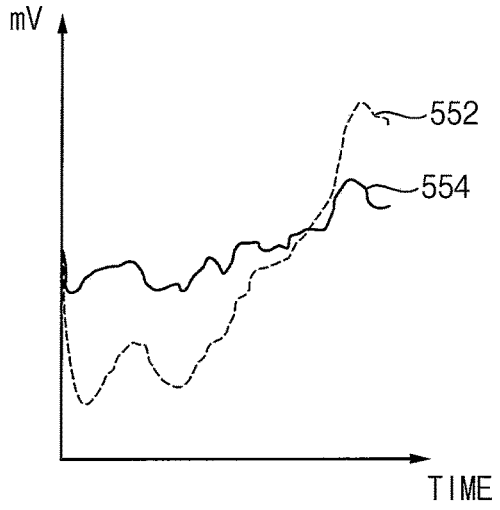
Figure 16D:
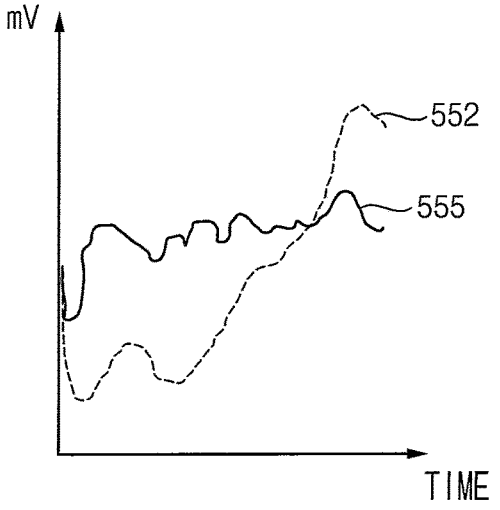

In FIG. 16A, a reference numeral 551 represents the load current IL provided to the load 395 in the LDO regulator 320*a* of FIG. 6. In FIG. 16B, a reference numeral 552 represents the output voltage VO in case that the resistive common mode feedback circuit 340 in the error amplifier 330, the adaptive bias circuit 350 and the droop adjusting circuit 400 are deactivated, and a reference numeral 553 represents the output voltage VO in case that the adaptive bias circuit 350 and the droop adjusting circuit 400 are activated. In FIG. 16C, a reference numeral 552 represents the output voltage VO in case that the resistive common mode feedback circuit 340 in the error amplifier 330, the adaptive bias circuit 350 and the droop adjusting circuit 400 are deactivated, and a reference numeral 554 represents the output voltage VO in case that the resistive common mode feedback circuit 340 and the droop adjusting circuit 400 are activated. In FIG. 16D, a reference numeral 552 represents the output voltage VO in case that the resistive common mode feedback circuit 340 in the error amplifier 330, the adaptive bias circuit 350 and the droop adjusting circuit 400 are deactivated, and a reference numeral 555 represents the output voltage VO in case that the resistive common mode feedback circuit 340 and the adaptive bias circuit 350 are activated.

Referring to FIGS. 16A-16D, when the voltage level of the output voltage VO rapidly decreases in response to a rapid increase of the load current IL provided to the load 395, it is noted that the output voltage VO is efficiently recovered and reduced level of the output voltage VO is rapidly recovered when two of the resistive common mode feedback circuit 340, the adaptive bias circuit 350 and the droop adjusting circuit 400 are in operation.

Figure 17A:
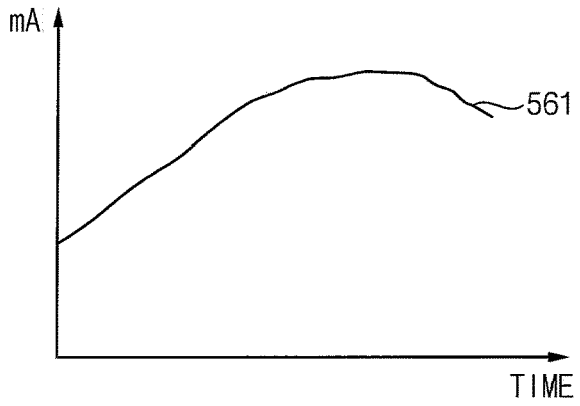
FIGS. 17A and 17B illustrate a load current and output voltages in various situations in the LDO regulator according to example embodiments.
Figure 17B:
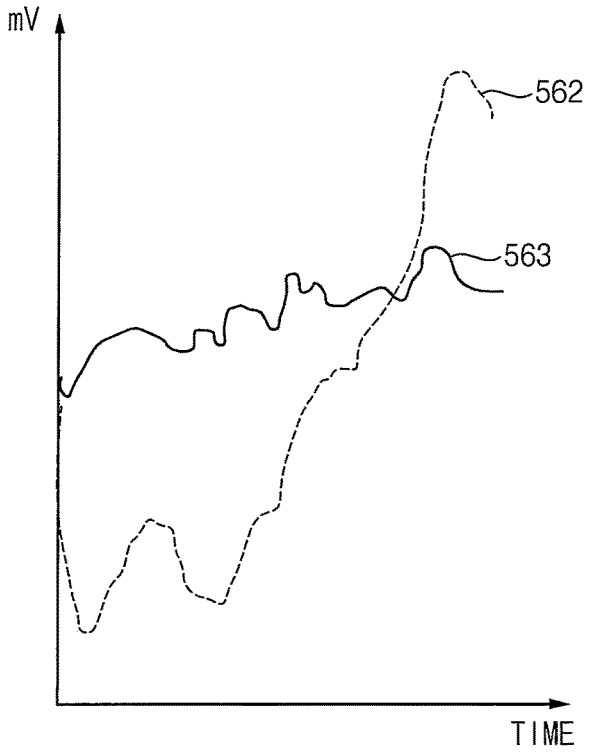

FIGS. 17A and 17B illustrate illustrates a load current and output voltages in various situations in the LDO regulator according to example embodiments.

In FIG. 17A, a reference numeral 561 represents the load current IL provided to the load 395 in the LDO regulator 320*a* of FIG. 6. In FIG. 17B, a reference numeral 562 represents the output voltage VO in case that the resistive common mode feedback circuit 340 in the error amplifier 330, the adaptive bias circuit 350 and the droop adjusting circuit 400 are deactivated, and a reference numeral 563 represents the output voltage VO in case that the resistive common mode feedback circuit 340 in the error amplifier 330, the adaptive bias circuit 350 and the droop adjusting circuit 400 are activated.

Referring to FIGS. 17A and 17B, when the voltage level of the output voltage VO rapidly decreases in response to a rapid increase of the load current IL provided to the load 395, it is noted that the output voltage VO is efficiently recovered and reduced level of the output voltage VO is rapidly recovered when the resistive common mode feedback circuit 340, the adaptive bias circuit 350 and the droop adjusting circuit 400 operate.

Figure 18:
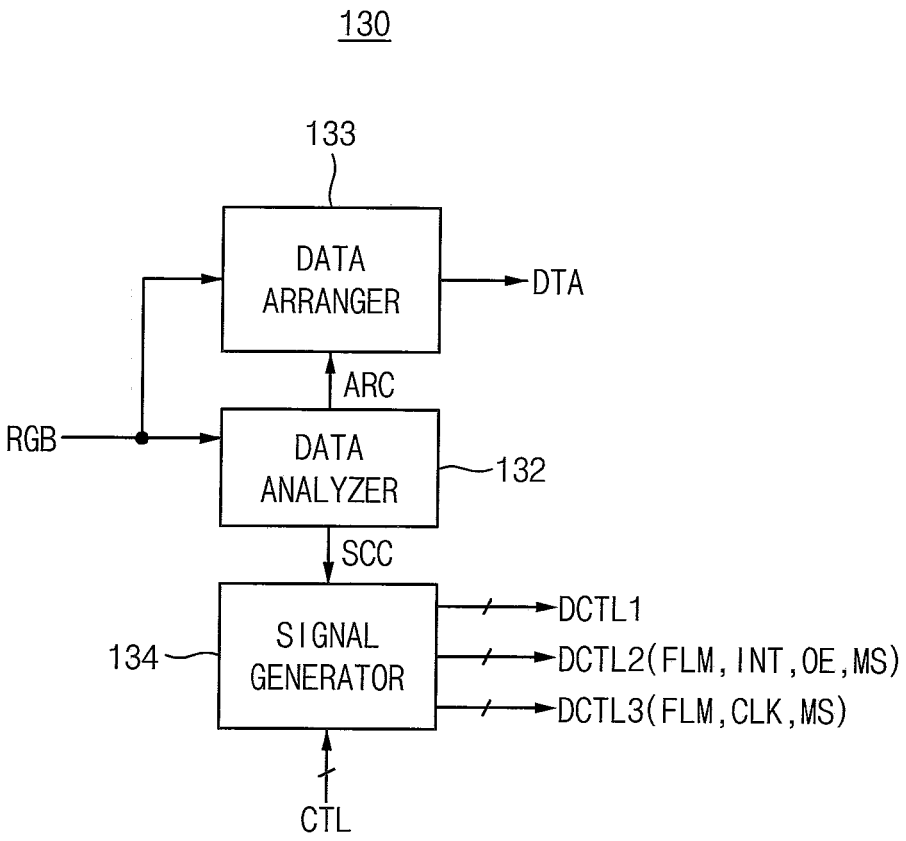
FIG. 18 is a block diagram illustrating an example of the timing controller in the OLED display device of FIG. 1 according to example embodiments.

FIG. 18 is a block diagram illustrating an example of the timing controller in the OLED display device of FIG. 1 according to example embodiments.

Referring to FIG. 18, the timing controller 130 may include a data analyzer 132, a data arranger 133 and a signal generator 134.

The data analyzer 132 generates an arrangement control signal ARC a scan control sequence signal SCC based on the input image data RGB. The data analyzer 132 may provide the arrangement control signal ARC to the data arranger 133 and the scan control signal SCC to the signal generator 134.

The data analyzer 132 may analyze grey levels of the input image data RGB per each data line to generate the arrangement control signal ARC. The data arranger 133 rearranges the input image data RGB according to the arrangement control signal ARC to output the data signal DTA.

The signal generator 134 may generate the first driving control signal DCTL1 that controls the data driver circuit 150, the second driving control signal DCTL2 that controls the scan driver circuit 200 and the third driving control signal DCTL3 that controls the emission driver circuit 260 based on the control signal CTL and the scan control signal SCC. The signal generator 134 may generate the power control signal PCTL that controls the voltage generator 300, in response to the control signal CTL. The second driving control signal DCTL2 may include a starting signal FLM (frame line mark), a plurality of initialization signal INT and a plurality of output enable signal OE and a mode signal MS associated with a scan mode. The third driving control signal DCTL3 may include the starting signal FLM, a clock signal CLK and the mode signal MS.

Figure 19:
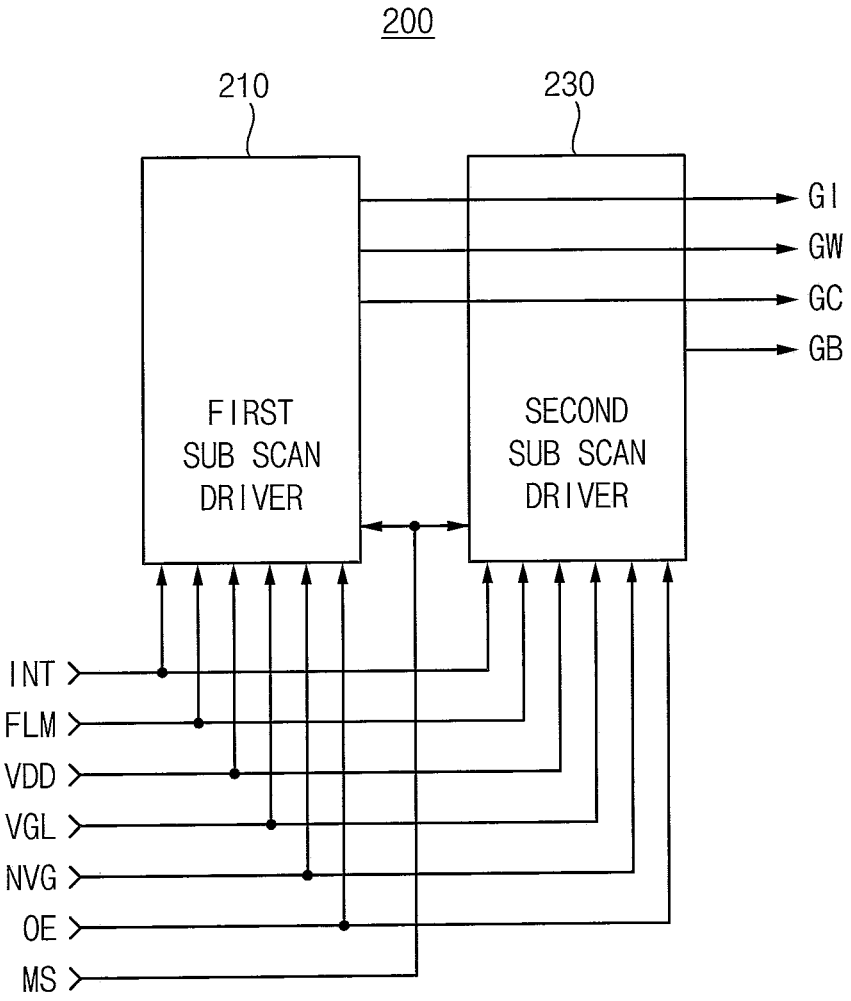
FIG. 19 is a block diagram illustrating an example of the scan driver circuit in the OLED display device of FIG. 1 according to example embodiments.

FIG. 19 is a block diagram illustrating an example of the scan driver circuit in the OLED display device of FIG. 1 according to example embodiments.

Referring to FIG. 19, the scan driver circuit 200 may include a first sub scan driver 210 and a second sub scan driver 230.

The first sub scan driver 210 may receive an initialization signal INT, the starting signal FLM, the first sub driving voltage VGH, the second sub driving voltage VGL, the negative voltage NVG, the output enable signal OE and the mode signal MS, may generate the first scan signal GI, the second scan signal GW and the third scan signal GC based on the initialization signal INT, the starting signal FLM, the first sub driving voltage VGH, the second sub driving voltage VGL, the negative voltage NVG, the output enable signal OE and the mode signal MS and may determine scan on-time of each of the first scan signal GI, the second scan signal GW and the third scan signal GC.

The second sub scan driver 230 may receive the initialization signal INT, the starting signal FLM, the first sub driving voltage VGH, the second sub driving voltage VGL, the negative voltage NVG, the output enable signal OE and the mode signal MS, may generate the fourth scan signal GB based on the initialization signal INT, the starting signal FLM, the first sub driving voltage VGH, the second sub driving voltage VGL, the negative voltage NVG, the output enable signal OE and the mode signal MS and may determine scan on-time the fourth scan signal GB.

Figure 20:
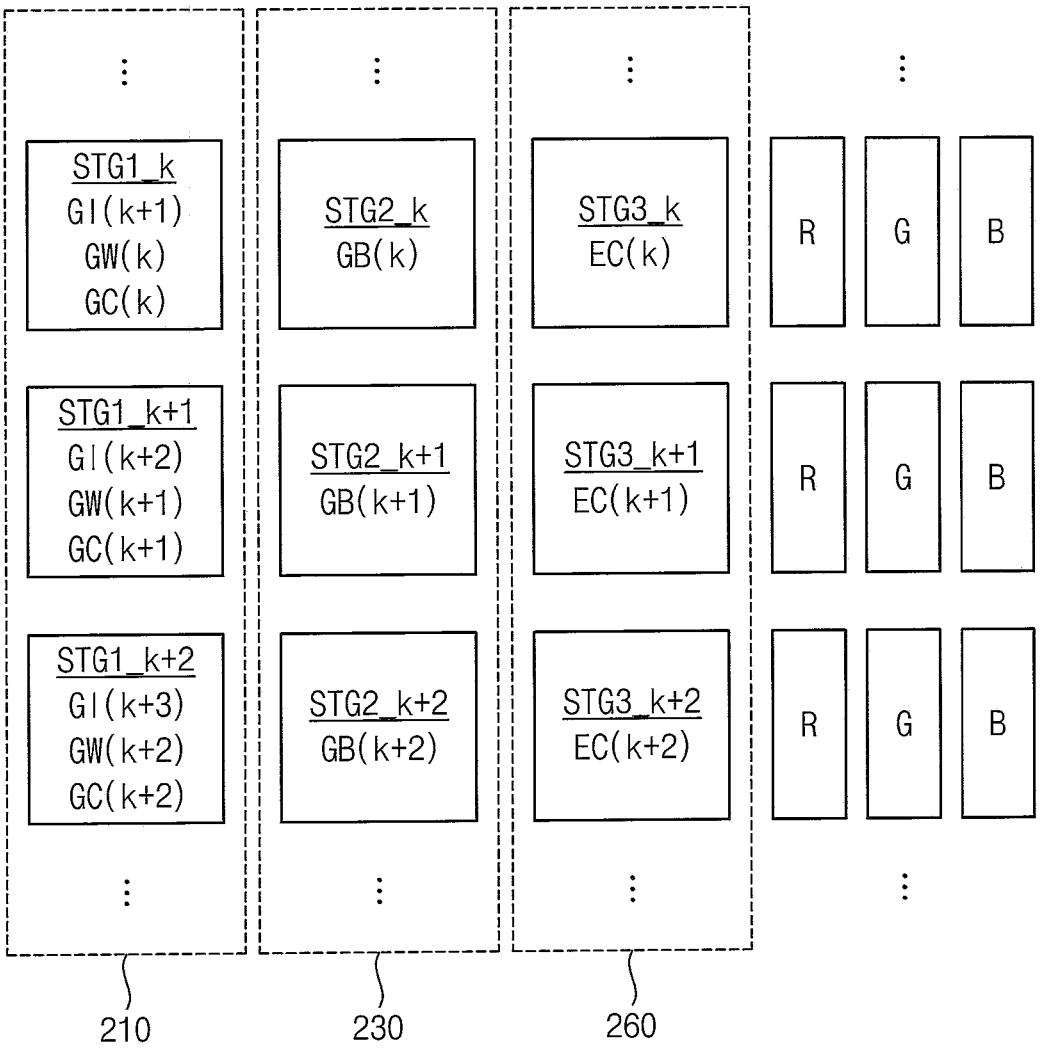
FIG. 20 illustrates the scan driver circuit of FIG. 19 and the emission driver circuit in FIG. 1 altogether.

FIG. 20 illustrates the scan driver circuit of FIG. 19 and the emission driver circuit in FIG. 1 altogether.

In FIG. 20, some stages of a plurality of stages in the first sub scan driver 210 and the sub second scan driver 230 and some stages of a plurality of stages in the emission driver circuit 260 in FIG. 1 are illustrated.

Referring to FIG. 20, the first sub scan driver 210 may include stages STG1_*k*, STG1_*k*+1 and STG1_*k*+2, the second sub scan driver 230 may include stages STG2_*k*, STG2_*k*+1 and STG2_*k*+2 and the emission driver circuit 260 may include stages STG3_*k*, STG3_*k*+1 and STG3_*k*+2. Here, k is a natural number and may be one of 1~n.

Each of the stages STG2_k, STG2_k+1 and STG2_k+2 in the second sub scan driver 230 may generate respective one of fourth scan signals GB(k), GB(k+1) and GB(k+2) associated with corresponding pixel rows of the pixels 111 in FIG. 1, and each of the STG3_k, STG3_k+1 and STG3_k+2 in the emission driver circuit 260 may generate respective one of emission control signals EC(k), EC(k+1) and EC(k+2) associated with corresponding pixel rows of the pixels 111 in FIG. 1.

The stage STG1_k in the first sub scan driver 210 may generate a first scan signal GI(k+1) associated with a (k+1)-th pixel row, a second scan signal GW(k) associated with a k-th pixel row and a third scan signal GC(k) associated with the k-th pixel row.

The stage STG1_k+1 in the first sub scan driver 210 may generate a first scan signal GI(k+2) associated with a (k+2)-th pixel row, a second scan signal GW(k+1) associated with the (k+1)-th pixel row and a third scan signal GC(k+1) associated with the (k+1)-th pixel row. The stage STG1_k+2 in the first sub scan driver 210 may generate a first scan signal GI(k+3) associated with a (k+3)-th pixel row, a second scan signal GW(k+2) associated with the (k+2)-th pixel row and a third scan signal GC(k+2) associated with the (k+2)-th pixel row.

That is, the first sub scan driver 210 may be fabricated by merging circuits associated with the second scan signal GW and the third scan signal GC or may be fabricated by merging circuits associated with the first scan signal GI, the second scan signal GW and the third scan signal GC. Therefore, an occupied area by the first sub scan driver 210 may be reduced.

In FIG. 20, R, G and B represent pixels displaying corresponding colors, respectively.

Figure 21:
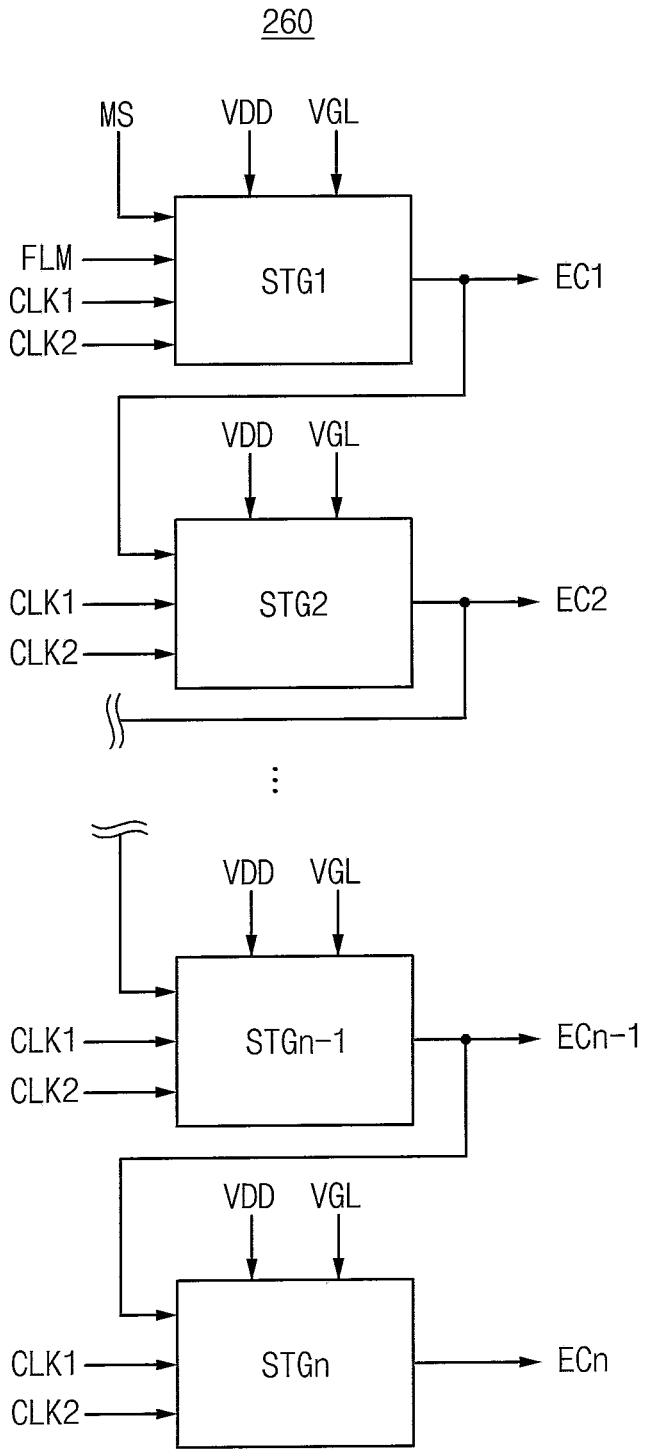
FIG. 21 is a block diagram illustrating the emission driver circuit shown in the OLED display device of FIG. 1 according to example embodiments.

FIG. 21 is a block diagram illustrating the emission driver circuit shown in the OLED display device of FIG. 1 according to example embodiments.

Referring to FIG. 21, the emission driver circuit 260 may include a plurality of stages STG1~STGn connected to each other one after another to sequentially output the emission control signals EC1~ECn.

The stages STG1~STGn are connected to the emission control lines EL1~ELn, respectively, and sequentially output the emission control signals EC1~ECn. The emission control signals EC1~ECn overlap each other during a predetermined period.

Each of the stages STG1~STGn receives the second operating voltage VGL and the first operating voltage VDD having the voltage level higher than that of the second operating voltage VGL. In addition, each of the stages STG1~STGn receives the first clock signal CLK1 and the second clock signal CLK2 and some of the stages STG1~STGn receive the mode signal MS. The mode signal MS may determine a number of horizontal periods included in the non-emission interval. That is, the mode signal MS may determine a time interval of the non-emission interval.

Hereinafter, the emission control signals EC1~EC2 output through the emission control lines EL1~ELn are referred to as first to n-th emission control signals.

Among the stages STG1~STGn, a first stage STG1 is driven in response to the starting signal FLM. In detail, the first stage STG1 receives the first driving voltage VDD and the second driving voltage VGL and generates the first emission control signal EC1 in response to the starting signal FLM, the first clock signal CLK1, the second clock signal CLK2 and the mode signal MS. The first emission control signal EC1 is applied to the pixels in the pixel row through the first emission control line EL1.

The stages STG1~STGn are connected to each other one after another and are sequentially driven. In detail, a present stage is connected to an output electrode of a pervious stage and receives the emission control signal output from the previous stage. The present stage is driven in response to the emission control signal provided from the previous stage.

For example, a second stage STG2 may receive the first emission control signal EC1 output from the first stage STG1 and is driven in response to the first emission control signal EC1. The second stage STG2 receives the first driving voltage VDD and the second driving voltage VGL and generates the second emission control signal EC2 in response to the first emission control signal EC1, the first clock signal CLK1, and the second clock signal CLK2. The second emission control signal EC2 is applied to the pixels in the pixel row through the second emission control line EL2. The other stages STG3 to STGn are driven in the same way as the second stage STG2, and thus details thereof will not be repeated.

Figure 22:
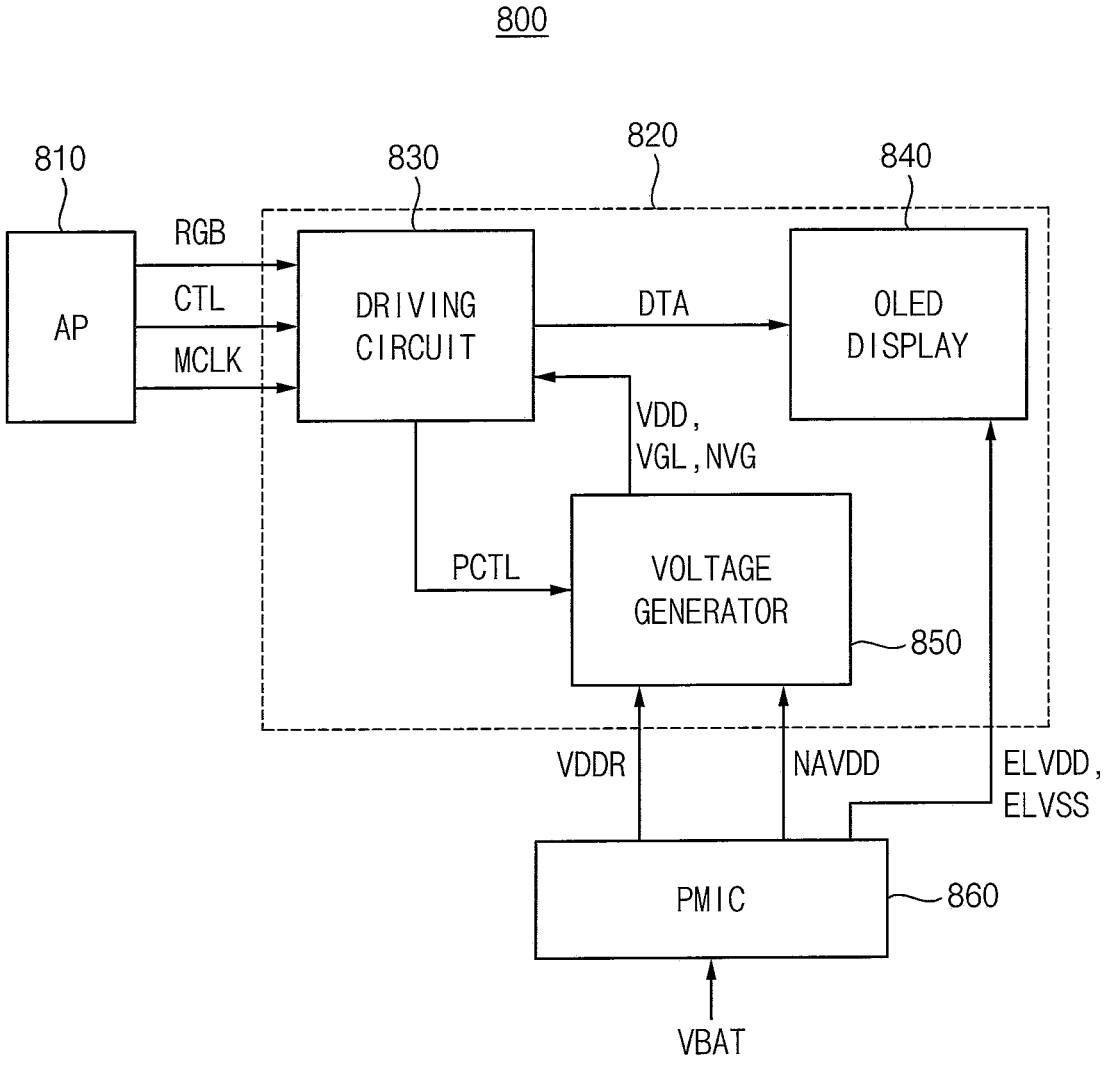
FIG. 22 is a block diagram illustrating an example of a display system according to example embodiments.

FIG. 22 is a block diagram illustrating an example of a display system according to example embodiments.

Referring to FIG. 22, a display system 800 may include an application processor (AP) 810, an OLED display device 820 and a power management integrated circuit (PMIC) 860.

The OLED display device 820 may include a driving circuit 830, a display panel 840 and a voltage generator 850. According to an example embodiment, the display panel may be an OLED display.

The voltage generator 850 may provide initialization voltages to the display panel 840 in response to a power control signal PCTL from the driving circuit 830. The voltage generator 850 may generate a first driving voltage VDD, a second driving voltage VGL and a negative voltage NVG based on a first driving voltage VDDR and a second driving voltage NAVDD and may provide the first operating voltage VDD, the second operating voltage VGL and the negative voltage NVG to a scan driver circuit of the driving circuit 820. The voltage generator 850 may include a plurality of LDO regulators configured to generate the first operating voltage VDD, the second operating voltage VGL and the negative voltage NVG, respectively At least one of the plurality of LDO regulators may employ the LDO regulator 320*a* of FIG. 8.

Therefore, the at least one LDO regulator may include a power transistor, an error amplifier and a droop adjusting circuit. The power transistor may regulate a driving voltage based on a gate voltage of a gate node to provide an output voltage at an output node. The error amplifier may output the gate voltage by amplifying a voltage difference between a reference voltage and a feedback voltage proportional to the output voltage. The droop adjusting circuit may be connected between the gate node and the output node and coupled to the output voltage. The droop adjusting circuit may adjust the gate voltage to compensate for a change of the output voltage based on a change of a load current which is provided to a load from the output node. Therefore, the at least one LDO regulator may recover reduced voltage level of the output voltage rapidly when the output voltage decreases and logic circuits operating the output voltage may operate stably.

The scan driver circuit may generate scan signals to be provided to the display panel 840 based on the first operating voltage VDD, the second operating voltage VGL and the negative voltage NVG.

The driving circuit 830 and the voltage generator 850 may be incorporated into one integrated circuit (IC).

The PMIC 860 may generate a high power supply voltage ELVDD and a low power supply voltage ELVSS based on a battery voltage VBAT and may provide the high power supply voltage ELVDD and the low power supply voltage ELVSS to the display panel 840. In addition, the PMIC 860 may generate the first driving voltage VDDR and the second driving voltage NAVDD based on the battery voltage VBAT and may provide the first driving voltage VDDR and the second driving voltage NAVDD to the voltage generator 850.

The OLED display system 800 may be a portable device such as a laptop, a cellular phone, a smart phone, a personal computer (PC), a personal digital assistant (PDA), a portable multi-media player (PMP), a MP3 player, an automotive navigation system, etc.

The application processor (AP) 810 provides an image signal RGB, a control signal CTL and a main clock signal MCLK to the OLED display device 820, and the driving circuit 830 may provide data DTA to the display panel 840.

Figure 23:
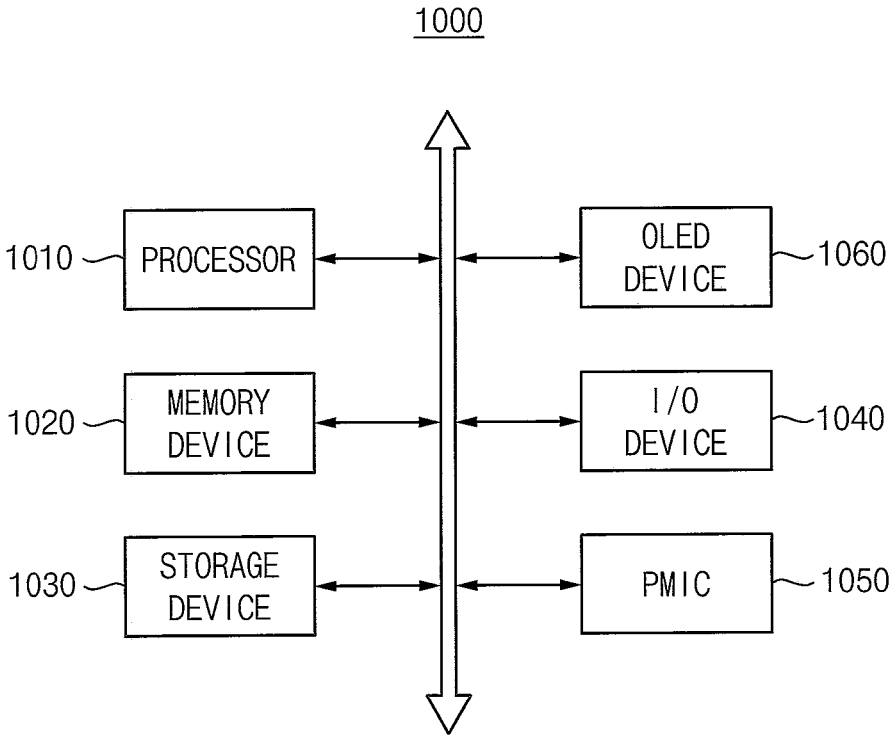
FIG. 23 is a block diagram illustrating an electronic device including an OLED display device according to example embodiments.

FIG. 23 is a block diagram illustrating an electronic device including an OLED display device according to example embodiments.

Referring to FIG. 23, an electronic device 1000 includes a processor 1010, a memory device 1020, a storage device 1030, an input/output (I/O) device 1040, a power management integrated circuit (PMIC) 1050, and an OLED display device 1060. The electronic device 1000 may further include a plurality of ports for communicating a video card, a sound card, a memory card, a universal serial bus (USB) device, other electronic systems, etc.

The processor 1010 may perform various computing functions or tasks. The processor 1010 may be for example, a microprocessor, a central processing unit (CPU), etc. The processor 1010 may be connected to other components via an address bus, a control bus, a data bus, etc. Further, the processor 1010 may be coupled to an extended bus such as a peripheral component interconnection (PCI) bus.

The memory device 1020 may store data for operations of the electronic system 1000. For example, the memory device 1020 may include at least one non-volatile memory device such as a flash memory device and/or at least one volatile memory device such as a dynamic random access memory (DRAM) device, a static random access memory (SRAM) device, a mobile dynamic random access memory (mobile DRAM) device, etc.

The storage device 1030 may be, for example, a solid state drive (SSD) device, a hard disk drive (HDD) device, a CD-ROM device, etc. The I/O device 1040 may be, for example, an input device such as a keyboard, a keypad, a mouse, a touch screen, etc., and/or an output device such as a printer, a speaker, etc. The PMIC 1050 may supply power for operations of the electronic system 1000. The organic light emitting display device 1060 may communicate with other components via the buses or other communication links.

The OLED display device 1060 may employ the mobile device 100 in FIG. 1. Therefore, the OLED display device 1060 may include a driving circuit and a display panel and the driving circuit may include a data driver circuit, a scan driver circuit and a voltage generator.

The voltage generator may include a plurality of LDO regulators. At least one of the plurality of LDO regulators may employ the LDO regulator 320*a* of FIG. 8. Therefore, the at least one LDO regulator may include a power transistor, an error amplifier and a droop adjusting circuit. The power transistor may regulate a driving voltage based on a gate voltage of a gate node to provide an output voltage at an output node. The error amplifier may output the gate voltage by amplifying a voltage difference between a reference voltage and a feedback voltage proportional to the output voltage. The droop adjusting circuit may be connected between the gate node and the output node and coupled to the output voltage. The droop adjusting circuit may adjust the gate voltage to compensate for a change of the output voltage based on a change of a load current which is provided to a load from the output node. Therefore, the at least one LDO regulator may recover reduced voltage level of the output voltage rapidly when the output voltage decreases and logic circuits operating the output voltage may operate stably The electronic device 1000 may be a mobile electronic device including the OLED display device 1060 such as a smart phone.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A low drop-out (LDO) regulator comprising:

a power transistor configured to regulate a driving voltage based on a gate voltage of a gate node of the power transistor to provide an output voltage to a load at an output node;

an error amplifier configured to output the gate voltage by amplifying a voltage difference between a reference voltage and a feedback voltage based on the output voltage; and a droop adjusting circuit configured to receive the output voltage provided to the load and adjust the gate voltage to compensate for a change of the output voltage based on a change of a load current provided to the load at the output node.

2. The LDO regulator of claim 1, wherein the droop adjusting circuit includes:

a first coupling capacitor provided between the output node and a first node, the first coupling capacitor configured to couple the output voltage to the first node;

a second coupling capacitor provided between the output node and a second node, the second coupling capacitor configured to couple the output voltage to the second node;

a buffer provided between the first node and a third node, the buffer configured to invert a first voltage of the first node;

an adjusting resistor provided between the third node and the second node;

an amplifier provided between the second node and the third node, the amplifier configured to amplify a second voltage of the second node with a positive gain;

a first transconductance amplifier provided between the third node and the output node, the first transconductance amplifier configured to amplify an average voltage with a first negative gain, the average voltage being obtained by averaging an output of the amplifier and a third voltage of the third node; and a second transconductance amplifier provided between the third node and the output node in parallel with the first transconductance amplifier, the second transconductance amplifier configured to amplify the average voltage with a second negative gain, and wherein the power transistor includes a source coupled to the driving voltage, a gate coupled to the gate node and a drain coupled to the output node.

3. The LDO regulator of claim 2, wherein, based on a decrease of the output voltage, the first coupling capacitor is further configured to decrease the first voltage;

the second coupling capacitor is further configured to decrease the second voltage;

the buffer is further configured to increase the third voltage based on a decrease of the first voltage;

the amplifier is further configured to amplify the second voltage by the positive gain;

the first transconductance amplifier is further configured to amplify the average voltage by the first negative gain;

the second transconductance amplifier is further configured to amplify the average voltage by the second negative gain;

a first output of the first transconductance amplifier and a second output of the second transconductance amplifier are summed at the gate node and are provided as the gate voltage; and the gate voltage decreases based on a decrease of the output voltage.

4. The LDO regulator of claim 2, wherein the buffer includes:

a first p-channel metal-oxide semiconductor (PMOS) transistor that includes a source coupled to the driving voltage, a gate coupled to the first node and a drain coupled to the first node; and a second PMOS transistor that includes a source coupled to the driving voltage, a gate coupled to the first node and a drain coupled to the third node.

5. The LDO regulator of claim 4, wherein, based on a decrease of the first voltage responding to the decrease of the output voltage, the second PMOS transistor is configured to increase a voltage level of the third voltage by increasing a current provided to the third node.

6. The LDO regulator of claim 2, wherein the buffer includes:

an n-channel metal-oxide semiconductor (NMOS) transistor that includes a drain coupled to the third node, a gate coupled to the second node and a source coupled to a ground voltage.

7. The LDO regulator of claim 6, wherein, based on an increase of the third voltage responding to the decrease of the output voltage the NMOS transistor is configured to increase a current sinking to the ground voltage from the gate node.

8. The LDO regulator of claim 2, wherein the first transconductance amplifier includes:

an n-channel metal-oxide semiconductor (NMOS) transistor that includes a drain coupled to the gate node, a gate coupled to the third node and a source coupled to a ground voltage.

9. The LDO regulator of claim 2, wherein the second transconductance amplifier includes:

a first p-channel metal-oxide semiconductor (PMOS) transistor that includes a source coupled to the driving voltage, a gate coupled to a fourth node and a drain coupled to the fourth node;

a second PMOS transistor that includes a source coupled to the driving voltage, a gate coupled to the fourth node and a drain coupled to the gate node;

a third PMOS transistor that includes a source coupled to the driving voltage, a gate coupled to a fifth node and a drain coupled to the fifth node;

a fourth PMOS transistor that includes a source coupled to the driving voltage, a gate coupled to the fifth node and a drain coupled to the fourth node;

a first n-channel metal-oxide semiconductor (NMOS) transistor that includes a drain coupled to the fifth node, a gate coupled to the third node and a source coupled to a ground voltage;

a fifth PMOS transistor that includes a source coupled to the driving voltage, a gate coupled to a sixth node and a drain coupled to the sixth node;

a sixth PMOS transistor that includes a source coupled to the driving voltage, a gate coupled to the sixth node and a drain coupled to a seventh node;

a second NMOS transistor that includes a drain coupled to the seventh node, a gate coupled to the seventh node and a source coupled to the ground voltage;

a third NMOS transistor that includes a drain coupled to the fourth node, a gate coupled to the seventh node and a source coupled to the ground voltage; and a fourth NMOS transistor that includes a drain coupled to the fourth node in parallel with the third NMOS transistor, a gate coupled to the seventh node and a source coupled to the ground voltage.

10. The LDO regulator of claim 9, wherein, based on an increase of the third voltage responding to the decrease of the output voltage, the first NMOS transistor is configured to increase a first current sinking to the ground voltage from the fifth node;

the fourth PMOS transistor is configured to increase a second current provided to the first PMOS transistor from the fourth PMOS transistor via the fourth node by mirroring the first current; and the second PMOS transistor is configured to decrease a voltage level of the gate voltage by decreasing a current provided to the gate node based on an increase of a voltage of the fourth node responding to the increase of the second current.

11. The LDO regulator of claim 1, further comprising:

an adaptive bias circuit configured to:

copy a supply current provided to the output node through the power transistor based on the gate voltage to generate a first current proportional to the supply current; and adjust a bias current provided to the error amplifier based on the first current.

12. The LDO regulator of claim 11, wherein the adaptive bias circuit includes:

a first p-channel metal-oxide semiconductor (PMOS) transistor that includes a source coupled to the driving voltage, a gate receiving a first bias voltage and a drain that provide the bias current to the error amplifier; and a load sensor configured to generate the first current by copying the supply current based on the gate voltage and configured to generate the first bias voltage based on the first current.

13. The LDO regulator of claim 12, wherein the load sensor includes:

a second PMOS transistor that includes a source coupled to the driving voltage, a gate coupled to a first node coupled to the gate of the first PMOS transistor and a drain coupled to the first node;

a third PMOS transistor that includes a source coupled to the driving voltage, a gate coupled to the gate node and a drain coupled to a second node;

a first n-channel metal-oxide semiconductor (NMOS) transistor that includes a drain coupled to the second node, a gate coupled to the second node and a source coupled to a ground voltage;

a second NMOS transistor that includes a drain coupled to the first node, a gate coupled to the second node and a source coupled to the ground voltage; and a current source connected between the first node and the ground voltage, the current source configured to sink a second current to the ground voltage, wherein the bias current corresponds to a sum of the first current and a second current, and wherein a ratio of channel width over a channel length of the third PMOS transistor correspond to 1/P of a ratio of channel width over a channel length of the power transistor, and P is a real number greater than one.

14. The LDO regulator of claim 1, wherein the error amplifier includes:

a first p-channel metal-oxide semiconductor (PMOS) transistor that includes a source coupled to the driving voltage, a gate coupled to a first node and a drain coupled to the first node;

a second PMOS transistor that includes a source coupled to the driving voltage, a gate coupled to a first node and a drain coupled to the gate node;

a third PMOS transistor that includes a source coupled to a second node receiving a bias current, a gate receiving the reference voltage and a drain coupled to a third node;

a fourth PMOS transistor that includes a source coupled to the second node, a gate receiving the feedback voltage and a drain coupled to a fourth node;

a first n-channel metal-oxide semiconductor (NMOS) transistor that includes a drain coupled to the first node, a gate coupled to the third node and a source coupled to a ground voltage;

a second NMOS transistor that includes a drain coupled to the gate node, a gate coupled to the fourth node and a source coupled to the ground voltage;

a third NMOS transistor that includes a drain coupled to the third node, a gate coupled to a fifth node and a source coupled to the ground voltage;

a fourth NMOS transistor that includes a drain coupled to the fourth node, a gate coupled to the fifth node and a source coupled to the ground voltage; and a resistive common mode feedback circuit connected to the third node, the fourth node and the fifth node, the resistive common mode feedback circuit configured to selectively increase an impedance of the error amplifier based on an enable signal.

15. The LDO regulator of claim 14, wherein the resistive common mode feedback circuit includes:

a first resistor connected between the third node and a sixth node;

a second resistor connected between the fourth node and the sixth node;

a first switch configured to selectively connect the fifth node and the sixth node based on the enable signal;

a second switch configured to connect the gate of the third NMOS transistor to one of the third node and the fifth node based on the enable signal; and a third switch configured to connect the gate of the fourth NMOS transistor to one of the fourth node and the fifth node based on the enable signal, and wherein based on in response to the enable signal, the resistive common mode feedback circuit is configured to increase the impedance of the error amplifier by the first switch connecting the fifth node to the sixth node, the second switch connecting the gate of the third NMOS transistor to the fifth node and the third switch connecting the gate of the fourth NMOS transistor to the fifth node.

16. The LDO regulator of claim 1, further comprising:

a feedback circuit provided between the output node and a ground voltage, the feedback circuit configured to divide the output voltage to provide the feedback voltage.

17. The LDO regulator of claim 1, wherein the droop adjusting circuit is configured to:

generate a first voltage and a second voltage based on the decrease in the output voltage;

generate a third voltage by inverting the first voltage;

generate a fourth voltage by amplifying the second voltage;

generate a fifth voltage by amplifying an average of the third voltage and the fourth voltage by a first gain value;

generate a sixth voltage by amplifying the average of the third voltage and the fourth voltage by a second gain value;

adjusting the gate voltage based on a sum of the fifth voltage and the sixth voltage.

18. A mobile device comprising:

a display panel including a plurality of pixels;

a driving circuit configured to provide a plurality of scan signals to the display panel through a plurality of scan lines and provide data voltages to the display panel through a plurality of data lines;

a voltage generator including at least one low drop-out (LDO) regulator configured to generate an operating voltage based on a first driving voltage, the voltage generator configured to provide the operating voltage to the driving circuit; and a power management application circuit (PMIC) configured to apply a high power supply voltage and a low power supply voltage to the display panel and configured to generate the first driving voltage and a second driving voltage based on a battery voltage, wherein the driving circuit is configured to generate at least one of the plurality of scan signals based on the operating voltage, and wherein the at least one LDO regulator includes:

a power transistor configured to regulate the first driving voltage based on a gate voltage of a gate node of the power transistor to provide the operating voltage as an output voltage to a load at an output node;

an error amplifier configured to output the gate voltage by amplifying a voltage difference between a reference voltage and a feedback voltage based on the output voltage; and a droop adjusting circuit configured to receive the output voltage provided to the load and adjust the gate voltage to compensate for a change of the output voltage based on a change of a load current provided to the load at the output node.

19. The mobile device of claim 18, wherein the at least one LDO regulator further includes:

an adaptive bias circuit configured to copy a supply current provided to the output node through the power transistor based on the gate voltage to generate a first current proportional to the supply current, and configured to adjust a bias current provided to the error amplifier based on the first current, wherein the error amplifier includes a resistive common mode feedback circuit configured to increase an impedance of the error amplifier, and wherein each of the droop adjusting circuit, the adaptive bias circuit and the resistive common mode feedback circuit is selectively activated.

20. The mobile device of claim 18, wherein the driving circuit includes:

a scan driver configured to provide first through fourth scan signals to each of pixel rows including the plurality of pixels;

a data driver configured to provide the data voltages corresponding to data signal to the data lines connected to the plurality of pixels;

an emission driver configured to provide emission control signals to a plurality emission control lines connected to the plurality of pixels; and a timing controller configured to control the scan driver, the data driver, the emission driver and the voltage generator, wherein the timing controller is configured to process an input image data to generate the data signal.

21. A low drop-out (LDO) regulator comprising:

a power transistor configured to regulate a driving voltage based on a gate voltage of a gate node of the power transistor to provide an output voltage to a load at an output node;

an error amplifier configured to output the gate voltage by amplifying a voltage difference between a reference voltage and a feedback voltage based on the output voltage; and a droop adjusting circuit configured to receive the output voltage provided to the load and adjust the gate voltage to compensate for a change of the output voltage based on a change of a load current provided to the load at the output node; and an adaptive bias circuit configured to copy a supply current provided to the output node through the power transistor based on the gate voltage to generate a first current proportional to the supply current, and configured to adjust a bias current provided to the error amplifier based on the first current, wherein the error amplifier includes a resistive common mode feedback circuit configured to increase an impedance of the error amplifier, and wherein each of the droop adjusting circuit, the adaptive bias circuit and the resistive common mode feedback circuit is selectively activated.

22. The LDO regulator of claim 21, wherein the droop adjusting circuit is selectively activated based on a first enable signal output by a timing controller;

wherein the adaptive bias circuit is selectively activated based on a second enable signal output by the timing controller; and wherein the resistive common mode feedback circuit is selectively activated based on a third enable signal output by the timing controller.

* * * * *